US011982293B2

(12) United States Patent
Jung et al.

(10) Patent No.: US 11,982,293 B2
(45) Date of Patent: May 14, 2024

(54) BLOWER

(71) Applicant: LG ELECTRONICS INC., Seoul (KR)

(72) Inventors: Jaehyuk Jung, Seoul (KR); Seungho Baek, Seoul (KR); Kidong Kim, Seoul (KR); Seokho Choi, Seoul (KR); Hoojin Kim, Seoul (KR); Haein Jung, Seoul (KR); Changhoon Lee, Seoul (KR); Hosik Jang, Seoul (KR); Kibbum Park, Seoul (KR); Yongmin Kim, Seoul (KR); Jaehyeon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/908,625

(22) PCT Filed: Mar. 3, 2021

(86) PCT No.: PCT/KR2021/002600
§ 371 (c)(1),
(2) Date: Sep. 1, 2022

(87) PCT Pub. No.: WO2021/177713
PCT Pub. Date: Sep. 10, 2021

(65) Prior Publication Data

US 2023/0122270 A1 Apr. 20, 2023

(30) Foreign Application Priority Data

Mar. 4, 2020 (KR) ..... 10-2020-0027284
Mar. 4, 2020 (KR) ..... 10-2020-0027287
(Continued)

(51) Int. Cl.
*F04D 25/08* (2006.01)
*F04D 29/46* (2006.01)
(Continued)

(52) U.S. Cl.
CPC ..... *F04D 29/462* (2013.01); *F04D 25/08* (2013.01); *F24F 13/12* (2013.01);
(Continued)

(58) Field of Classification Search
CPC ..... F04D 25/08; F04D 25/10; F04D 29/563; F04D 29/4246; F04D 29/462;
(Continued)

(56) References Cited

U.S. PATENT DOCUMENTS 8,403,640 B2 * 3/2013 Gammack ..... F04D 27/004 415/213.1
9,745,981 B2 * 8/2017 Dos Reis ..... F04F 5/16
(Continued)

FOREIGN PATENT DOCUMENTS

CN 104863871 8/2015
CN 107085456 8/2017
(Continued)

OTHER PUBLICATIONS

Korean Office Action dated May 17, 2023 issued in Application No. 10-2020-0027284.
(Continued)

*Primary Examiner* — Justin D Seabe
*Assistant Examiner* — Behnoush Haghighian
(74) *Attorney, Agent, or Firm* — KED & ASSOCIATES, LLP

(57) ABSTRACT

A blower is disclosed. The blower of the present disclosure comprises: a fan for producing air flow; a lower body providing an inner space in which the fan is installed, and having an intake hole through which air passes; an upper
(Continued)

body placed on the lower body to form a flow passage which communicates with the inner space of the lower body, and having a space which is formed to pass through the upper body in the forward and backward direction, wherein the upper body includes a slit which is formed through the upper body and through which air flowing through the flow passage of the upper body is discharged to the space, and the slit comprises: a rear slit adjacent to the rear end of the upper body; and a front slit adjacent to the front end of the upper body.

19 Claims, 24 Drawing Sheets

(30) Foreign Application Priority Data

Jun. 2, 2020 (KR) ..... 10-2020-0066279
Sep. 8, 2020 (KR) ..... 10-2020-0114465

(51) Int. Cl.
*F24F 13/12* (2006.01)
*F04D 29/42* (2006.01)
*F04F 5/16* (2006.01)
*F04F 5/46* (2006.01)

(52) U.S. Cl.
CPC ..... *F04D 29/4246* (2013.01); *F04F 5/16* (2013.01); *F04F 5/46* (2013.01); *F24F 2221/28* (2013.01)

(58) Field of Classification Search
CPC ..... F04D 29/464; F04D 29/46; F04D 29/56; F04D 27/002; F04D 27/003; F04F 5/16; F04F 5/461; F24F 2013/1446; F24F 1/0014; F24F 13/12; F24F 2221/28; F24F 7/007; F24F 13/26; F24F 13/20
See application file for complete search history.

(56) References Cited

U.S. PATENT DOCUMENTS 11,022,146 B2 * 6/2021 Mogridge ..... F04D 29/4246
11,326,612 B2 * 5/2022 De' Longhi ..... F04D 25/10
11,326,613 B2 * 5/2022 De' Longhi ..... F04D 29/541
2010/0226752 A1 * 9/2010 Gammack ..... F04D 25/08 417/423.1
2013/0129490 A1 * 5/2013 Dos Reis ..... F24F 7/007 415/182.1
2014/0255173 A1 * 9/2014 Poulton ..... F04D 25/08 415/182.1
2018/0045203 A1 * 2/2018 Yang ..... F04F 5/16
2019/0170157 A1 * 6/2019 Mogridge ..... F04D 25/08
2019/0170162 A1 * 6/2019 Jennings ..... F04D 19/002
2019/0277297 A1 * 9/2019 De' Longhi ..... F04D 25/10
2019/0301475 A1 * 10/2019 De' Longhi ..... F04D 29/541
2020/0318642 A1 * 10/2020 Lissner ..... F04F 5/46
2021/0207520 A1 * 7/2021 Azzouz ..... F04F 5/466
2022/0074419 A1 * 3/2022 Pouget ..... F24F 13/26

FOREIGN PATENT DOCUMENTS

| | | |
|---|---|---|
| CN | 206877265 | 1/2018 |
| JP | 2013-015114 | 1/2013 |
| JP | 2013-053596 | 3/2013 |
| JP | 2014-173604 | 9/2014 |
| JP | 2016-000967 | 1/2016 |
| JP | 6488261 | 3/2019 |
| JP | 2019-100341 | 6/2019 |
| KR | 10-2011-0099302 | 9/2011 |
| KR | 10-2011-0099318 | 9/2011 |
| KR | 10-2011-0100274 | 9/2011 |
| KR | 10-2013-0033434 | 4/2013 |
| KR | 10-2013-0033435 | 4/2013 |
| KR | 10-1472758 | 12/2014 |
| KR | 10-2018-0125425 | 11/2018 |
| KR | 10-2019-0015325 | 2/2019 |
| KR | 10-2019-0025443 | 3/2019 |
| KR | 10-2020-0089362 | 7/2020 |

OTHER PUBLICATIONS

Korean Office Action dated Apr. 6, 2023 issued in Application No. 10-2020-0066279.
Korean Office Action dated Apr. 6, 2023 issued in Application No. 10-2020-0114465.
International Search Report dated Nov. 30, 2020 issued in Application No. PCT/KR2020/005404.
International Search Report dated Jun. 25, 2021 issued in Application No. PCT/KR2021/002600.

* cited by examiner

BLOWER

CROSS-REFERENCE TO RELATED PATENT APPLICATIONS

This application is a U.S. National Stage Application under 35 U.S.C. § 371 of PCT Application No. PCT/KR2021/002600, filed Mar. 3, 2021, which claims priority to Korean Patent Application Nos. 10-2020-0027284, filed Mar. 4, 2020, 10-2020-0027287, filed Mar. 4, 2020, 10-2020-0066279, filed Jun. 2, 2020 and 10-2020-0114465, filed Sep. 8, 2020, whose entire disclosures are hereby incorporated by reference.

TECHNICAL FIELD

The present disclosure relates to a blower. In particular, the present disclosure relates to a blower that can variously adjust a blowing direction or a blowing range.

BACKGROUND ART

A blower can circulate air or generate airflow toward a user in an interior by generating flow of air. Recently, many researches are conducted about the air discharge structure of a blower that can make a user feel pleasant.

In relation to this, Korean Patent Application Publication Nos. KR2011-0099318, KR2011-0100274, KR2019-0015325, and KR2019-0025443 disclose a blowing device or a fan that blows air using Coanda effect.

Meanwhile, it was required to move or rotate a blowing device itself in order to adjust a blowing direction or a blowing range in the related art. Accordingly, there was a problem that it is difficult to effectively adjust blowing intensity or a blowing direction and excessive power is consumed.

DISCLOSURE

Technical Problem

An object of the present disclosure is to solve the problems described above and other problems.

Another object may be to provide a blower that can blow air using Coanda effect.

Another object of the present disclosure is to provide a blower that can generate airflow of direct wind or indirect wind by mixing air that is discharged from several slits.

Another object of the present disclosure is to provide a blower that has a door that can open and close a slit through which air is discharged to adjust a blowing direction or a blowing range.

Another object of the present disclosure is to provide various examples of a driving mechanism of a door that opens and closes a slit.

Technical Solution

According to an aspect of the present disclosure for achieving the objects described above, there is provided a blower including: a fan generating flow of air; a lower body providing an internal space in which the fan is installed, and having a suction hole through which air passes; and an upper body being an upper body, which is installed over the lower body and forms a channel that communicates with the internal space of the lower body, and having a space formed through the upper body in a front-rear direction, wherein the upper body includes a slit formed through the upper body and discharging air, which flows through the channel of the upper body, to the space, and the slit includes: a rear slit being adjacent to a rear end of the upper body; and a front slit being adjacent to a front end of the upper body.

Further, according to another aspect of the present disclosure, the rear slit may be formed through the upper body in a direction facing the space and inclined forward, and the front slit may be formed through the upper body in a direction facing a front of the space and inclined forward.

Further, according to another aspect of the present disclosure, the upper body may include an inner panel that faces the space and at which the rear slit and the front slit are formed, and a surface of the inner panel may be a curved surface that is convex toward the space.

Further, according to another aspect of the present disclosure, the upper body may further include: an inner sleeve forming the channel of the upper body; and a panel, which is a panel surrounding the inner sleeve, having the inner panel and an outer panel opposite to the inner panel, and the inner panel may form the front end and the rear end of the upper body by being in contact with the outer panel.

Further, according to another aspect of the present disclosure, the upper body may further include: an opening, which is an opening being adjacent to the rear end of the upper body and formed through the inner panel and the outer panel, having an inlet positioned at the channel of the upper body and an outlet forming the rear slit; and a slot, which is an opening being adjacent to the front end of the upper body and formed through the inner panel and the outer panel, having an inlet positioned at the channel of the upper body and an outlet forming the front slit, and the blower may further include a door installed at the inner sleeve and opening or closing at least one of the opening or the slot.

Further, according to another aspect of the present disclosure, the upper body may further include: a first upper body forming a first channel that communicates with the internal space of the lower body; and a second upper body spaced apart from the first upper body and formed a second channel that communicates with the internal space of the lower body, the space may be formed between the first upper body and the second upper body, the rear slit may further include: a first rear slit being adjacent to a rear end of the first upper body; and a second rear slit being adjacent to a front end of the second upper body, the front slit may further include: a first front slit being adjacent to a front end of the first upper body; and a second front slit being adjacent to a front end of the second upper body, the first rear slit and the first front slit may be formed on a surface of the first upper body that faces the space, and the second rear slit and the second front slit may be formed on a surface of the second upper body that faces the space.

Further, according to another aspect of the present disclosure, the first upper body may be spaced left apart from the second upper body, the first rear slit and the second rear slit may be left-right symmetric, and the first front slit and the second front slit may be left-right symmetric.

Further, according to another aspect of the present disclosure, the blower may further include: a first door assembly installed in the first upper body and opening or closing the first front slit; a second door assembly installed in the second upper body and opening or closing the second front slit; a controller electrically connected to the first door assembly and the second door assembly and controlling operations of the first door assembly and the second door assembly.

Further, according to another aspect of the present disclosure, the first door assembly may be left-right symmetric to the second door assembly.

Further, according to another aspect of the present disclosure, the first door assembly may include: a first door opening and closing the first front slit; and a first motor installed in the first upper body and providing power to the first door, and the first door may slide or rotate in the first upper body.

Further, according to another aspect of the present disclosure, a surface of the first upper body that faces the space may be a curved surface that is convex toward the space, and a surface of the first door that faces the space may be a curved surface having the same curvature as the surface of the first upper body that faces the space.

Further, according to another aspect of the present disclosure, the first door may open and close the first front slit by sliding in a circumferential direction of the first door in the first upper body in correspondence to operation of the first motor.

Further, according to another aspect of the present disclosure, the first door may further include: a first door plate elongated in a longitudinal direction of the first front slit and being able to slide in the circumferential direction of the first door; and a first door pin protruding from the first door plate, the first door assembly may further include: a first pinion fixed to a rotary shaft of the first motor; and a first link having a first rack engaged with the first pinion, the first link may include a first guide groove provided on a side of the first link and extending in a direction crossing a movement direction of the first rack, and the first door pin may be coupled to the first guide groove to be movable in a longitudinal direction of the first guide groove.

Further, according to another aspect of the present disclosure, the blower may further include: a first upper guide coupled to an upper end of the first door plate and guiding movement of the first door plate; and a first lower guide coupled to a lower end of the first door plate and guiding movement of the first door plate.

Further, according to another aspect of the present disclosure, the first door may open and close the first front slit by moving while drawing an arc in the first upper body in correspondence to operation of the first motor.

Further, according to another aspect of the present disclosure, the first door may include a front end that can be inserted in the first front slit in a circumferential direction of the first door, and the first door assembly may further include: a power transmission member transmitting power of the first motor to the first door; and a door guide provided on a side of the first door and guiding movement of the first door in the first upper body.

Further, according to another aspect of the present disclosure, the first door may open and close the first front slit by pivoting toward or away from the first front slit in the first upper body in correspondence to operation of the first motor.

Further, according to another aspect of the present disclosure, an area of the first door may be larger than a size of the first front slit, the first door may include a first surface covering or separating from the first front slit in the first upper body, and the first door assembly may further include: a first door shaft receiving power of the first motor and forming a pivot center of the first door; and a first connector that is provided on a side of the first door and to which the first door shaft is fixed.

Further, according to another aspect of the present disclosure, the controller may equally adjust opening and closing of the first front slit and opening and closing of the second front slit by synchronizing operations of the first door assembly and the second door assembly.

Further, according to another aspect of the present disclosure, the controller may differently adjust opening and closing of the first front slit and opening and closing of the second front slit by differently controlling operations of the first door assembly and the second door assembly.

Advantageous Effects

Effects of the blower according to the present disclosure are as follows.

According to at least one of embodiments of the present disclosure, it is possible to provide a blower that can blow air using Coanda effect.

According to at least one of embodiments of the present disclosure, it is possible to provide a blower that can generate airflow of direct wind or indirect wind by mixing air that is discharged from several slits.

According to at least one of embodiments of the present disclosure, it is possible to provide a blower that includes a door that can open and close a slit through which air for adjusting a blowing direction or a blowing range is discharged.

According to at least one of embodiments of the present disclosure, it is possible to provide various examples of a driving mechanism of a door that opens and closes a slit.

Applicability and an additional range of the present disclosure will be made clear from the following detailed description. However, various changes and modification within the spirit and scope of the present disclosure can be clearly understood by those skilled in the art, so the detailed description and specific embodiments such as preferred embodiments of the present disclosure should be understood only as examples.

DESCRIPTION OF DRAWINGS

FIG. 23 shows right biased airflow and FIG. 24 shows left biased airflow.

MODE FOR DISCLOSURE

Figure 1:
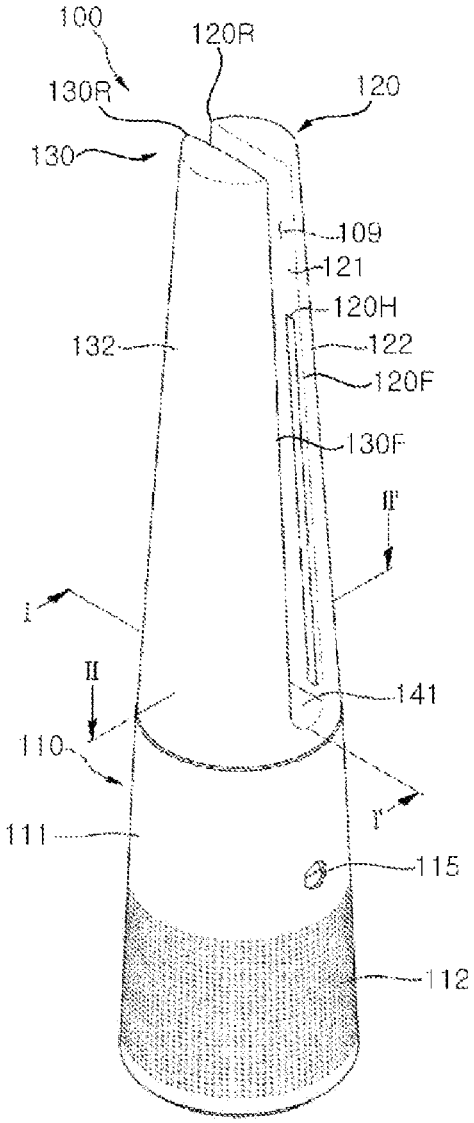
FIG. 1 is a perspective view of a blower according to an embodiment of the present disclosure.
Figure 1:
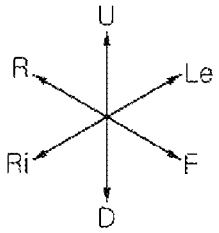

Hereafter, embodiments of the present disclosure will be described in detail with reference to the accompanying drawings and the same or similar components are given the same reference numerals regardless of the numbers of figures and are not repeatedly described.

In the following description, if it is decided that the detailed description of known technologies related to the present invention makes the subject matter of the embodiments described herein unclear, the detailed description is omitted. Further, the accompanying drawings are provided only for easy understanding of embodiments disclosed in the specification, the technical spirit disclosed in the specification is not limited by the accompanying drawings, and all changes, equivalents, and replacements should be understood as being included in the spirit and scope of the present disclosure.

Terms including ordinal numbers such as "first", "second", etc., may be used to describe various components, but the components are not to be construed as being limited to the terms. The terms are used only to distinguish one component from another component.

The characters 'U' (up), 'D' (down), 'Le' (left), 'Ri' (right), 'F' (forward), and 'R' (rearward) indicating directions are provided only for convenience of description and the spirit disclosed in the specification is not limited by the characters.

Referring to FIG. 1, a blower 100 may be elongated in the up-down direction. The blower 100 may have a base 102, a lower body 110, and upper bodies 120 and 130.

The base 102 (see FIG. 2) forms the lower surface of the blower 100 and may be placed on the floor of an interior. The base 102 may be formed entirely in a circular plate shape.

The lower body 110 may be disposed over the base 102. The lower body 110 may form the lower portion of the side of the blower 100. The lower body 110 may be formed entirely in a cylinder shape. For example, the diameter of the lower body 110 may decrease upward from the lower portion of the lower body 110. As another example, the diameter of the lower body 110 may be constantly maintained in the up-down direction. A suction hole 112 may be formed through a side of the lower body 110. For example, a plurality of suction holes 112 may be uniformly in the circumferential direction of the lower body 110. Accordingly, air can flow into the blower 100 from the outside through the plurality of suction holes 112.

The upper bodies 120 and 130 may be disposed over the lower body 110. The upper bodies 120 and 130 can provide a channel that communicates with the internal space of the lower body 110.

For example, referring to the figures, the upper bodies 120 and 130 may include a first upper body 120 and a second upper body 130 that are spaced apart from each other.

As another example, the upper bodies 120 and 130 may be provided as a single upper body. In this case, the upper bodies 120 and 130 may be elongated in the up-down direction over the lower body 110 or may be formed in a ring or open ring shape of a circular (elliptical) or track shape. The position of the single upper body 120, 130 with respect to the lower body may be determined in consideration of the shape of the upper body 120, 130 and the position, the shape, the number, etc. of discharge holes of air formed at the upper body 120, 130.

Hereafter, for brief description, the case in which the upper bodies 120 and 130 include the first upper body 120 and the second upper body 130 is described. Further, description for this can be applied in the same way not only to a case in which the number of the upper bodies 120 and 130 are two, but a case in which one upper body 120, 130 is provided as a single upper body.

The first upper body 120 and the second upper body 130 may be disposed over the lower body 110. The first upper body 120 and the second upper body 130 may form the upper portion of the side of the blower 100. The first upper body 120 and the second upper body 130 may be elongated in the up-down direction and may be spaced apart from each other in the left-right direction. A space 109 may be formed between the first upper body 120 and the second upper body 130 and may provide a channel of air. Meanwhile, the space 109 may be referred to as a blowing space, a valley, or a channel. Meanwhile, the first upper body 120 may be referred to as a first tower and the second upper body 130 may be referred to as a second tower.

The first upper body 120 may be spaced left apart from the second upper body 130. The first upper body 120 may be elongated in the up-down direction. The first upper body 120 may include first panels 121 and 122 that form the external shape of the first upper body 120. A first inner panel 121 may define a portion of the boundary of the space 109 while facing the space 109. For example, the surface of the first inner panel 121 may be a curved surface that is convex in a direction facing the space 109 or to the right from the first upper body 120. A first outer panel 122 may be opposite to the first inner panel 121. For example, the surface of the first outer panel 122 may be a curved surface that is convex in a direction opposite to the direction facing the space 109 or to the left from the first upper body 120.

For example, the first inner panel 121 may be elongated in the up-down direction. For example, the first outer panel 122 may be extended and inclined at a predetermined angle (acute angle) in the direction facing the space 109 or to the right with respect to a vertical line extending in the up-down direction.

In this case, the curvature of the first outer panel 122 may be larger than the curvature of the first inner panel 121. Further, the first inner panel 121 may form an edge by meeting with the first outer panel 122. The edge may be provided at a front end 120F and a rear end 120R of the first upper body 120. For example, the front end 120F may be extended and inclined at a predetermined angle (acute angle) rearward with respect to a vertical line extending in the up-down direction. For example, the rear end 120R may be extended and inclined at a predetermined angle (acute angle) forward with respect to a vertical line extending in the up-down direction.

The second upper body 120 may be spaced right apart from the first upper body 120. The second upper body 130 may be elongated in the up-down direction. The second upper body 130 may include second panels 131 and 132 that form the external appearance of the second upper body 130. A second inner panel 131 may define a portion of the boundary of the space 109 while facing the space 109. The surface of the second inner panel 131 may be a curved surface that is convex in a direction facing the space 109 or to the left from the second upper body 130. A second outer panel 132 may be opposite to the second inner panel 131. The surface of the second outer panel 132 may be a curved surface that is convex in a direction opposite to the direction facing the space 109 or to the right from the second upper body 130.

For example, the second inner panel 131 may be elongated in the up-down direction. For example, the second outer panel 132 may be extended and inclined at a predetermined angle (acute angle) in the direction facing the space 109 or to the left with respect to a vertical line extending in the up-down direction.

In this case, the curvature of the second outer panel 132 may be larger than the curvature of the second inner panel 131. Further, the second inner panel 131 may form an edge by meeting with the second outer panel 132. The edge may be provided at a front end 130F and a rear end 130R of the second upper body 130. For example, the front end 130F may be extended and inclined at a predetermined angle (acute angle) rearward with respect to a vertical line extending in the up-down direction. For example, the rear end 130R may be extended and inclined at a predetermined angle (acute angle) forward with respect to a vertical line extending in the up-down direction.

Meanwhile, the first upper body 120 and the second upper body 130 may be left-right symmetric with the space 109 therebetween. Further, the surface of the first outer panel 122 and the surface of the second outer panel 132 may be positioned on a virtual curved surface extending along the outer circumferential surface 111 of the lower body 110. In other words, the surface of the first outer panel 122 and the surface of the second outer panel 132 may smoothly extend to the outer circumferential surface 111 of the lower body 110. Further, the upper surface of the first upper body 120 and the upper surface of the second upper body 130 may be provided as horizontal surfaces. In this case, the blower 100 may be formed entirely in a truncated cone shape. Accordingly, the possibility that the blower 100 falls down due to external shock may decrease.

A groove 141 may be positioned between the first upper body 120 and the second upper body 130 and may be elongated in the front-rear direction. The groove 141 may be a curved surface that is concave downward. The groove 141 may have a first side connected with a lower side of the first inner panel 121 and a second side connected to the lower side of the second inner panel 131. The groove 141 may form a portion of the boundary of the space 109. Air flows in the lower body 110 by a fan 150 that will be described below may be distributed into the internal space of the first upper body 120 and the internal space of the second upper body 130 with the groove 141 therebetween. Meanwhile, the groove 141 may be referred to as a connection groove or a connection surface.

Meanwhile, a display 115 is provided at the front portion of the lower body 110 and can display operation information of the blower 100 or can provide an interface that can receive instructions of a user. For example, the display may include a touch panel.

Figure 2:
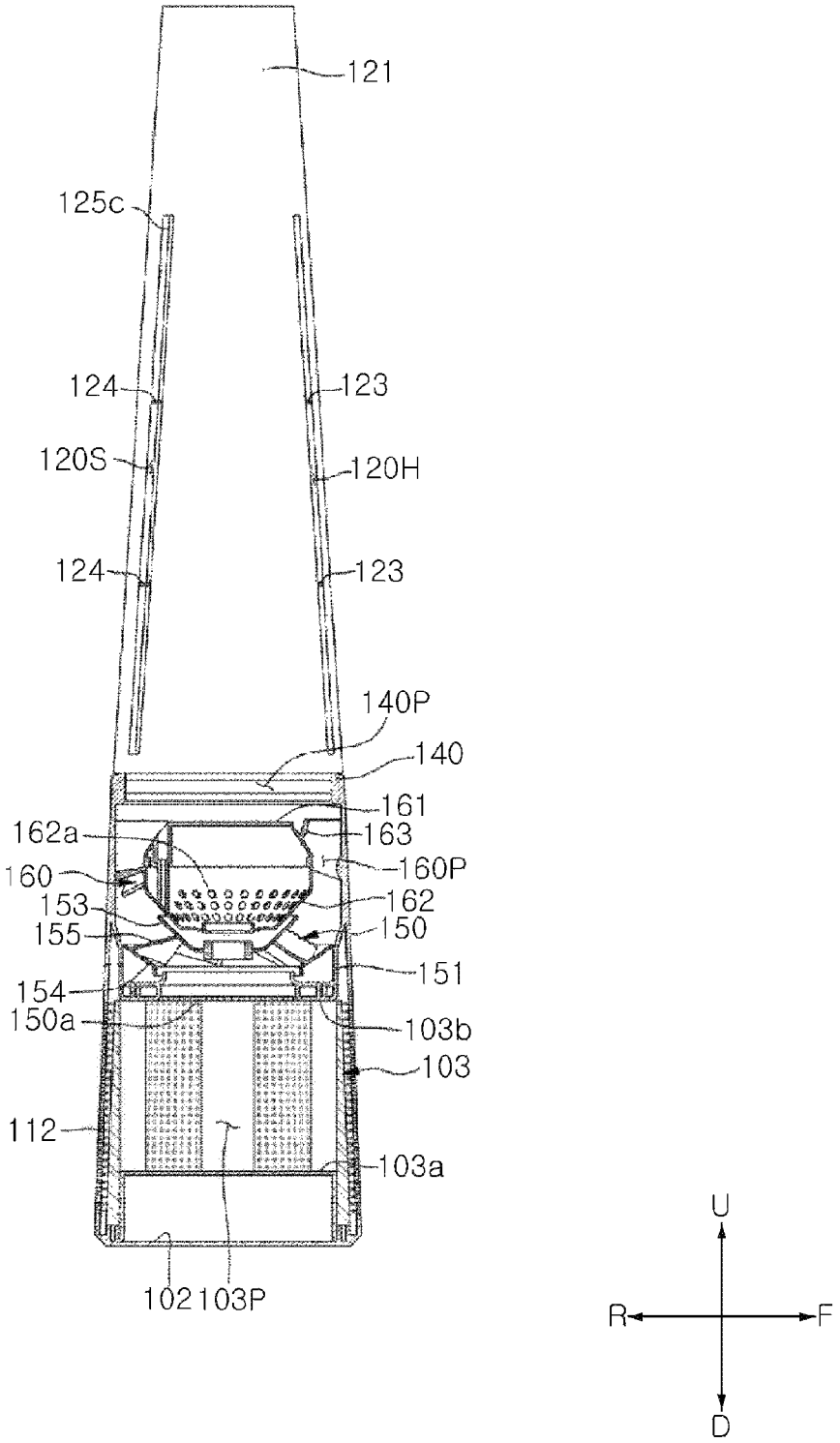
FIGS. 2 and 3 are cross-sections taken along line I-I' of FIG. 1.

Referring to FIG. 2, the lower body 110 may provide an internal space in which a filter 103, a fan 150, and an air guide 160 that will be described below are installed.

The filter 103 may be separably installed in the internal space of the lower body 110. The filter 103 may be formed entirely in a cylinder shape. That is, the filter 103 may include a hole 103P formed through the filter 103 in the up-down direction. In this case, indoor air can flow into the lower body 112 through the suction holes 111 by operation of the fan 150 that will be described below. Further, the indoor air flowing in the lower body 110 may be purified while flowing from the outer circumferential surface to the inner circumferential surface of the filter 103 and may flow upward through the hole 103P.

A filter supporter 103*a* is coupled to the filter 103 from under the filter 103 and can support the filter 103. For example, the filter supporter 103*a* may be formed in a ring shape. For example, the controller may be mounted in the filter supporter 103*a*. A filter frame 103*b* may be coupled to the filter 103 from above the filter 103. The filter frame 103*b* can provide a space in which the filter 103 is mounted.

A grill 150*a* may be disposed between the filter 103 and the fan 150. When the filter 103 is separated from the filter frame 103*b*, the grill 150*a* can prevent fingers of a user from coming into the fan 150.

The fan 150 may be installed in the internal space of the lower body 110 and may be disposed over the filter 103. The fan 150 can generate flow of air that flows into the blower 100 or is discharged from the blower 100 to the outside. The fan 150 may include a fan housing 151, a fan motor (not shown), a hub 153, a shroud 154, and a blade 155. Meanwhile, the fan 150 may be referred to as a fan assembly or a fan module.

The fan housing 151 may form the external shape of the fan 150. The fan housing 151 may include a suction port (not provided with a reference numeral) formed through the fan housing 151 in the up-down direction. The suction port is formed at the lower end of the fan housing 151 and may be referred to as a bell mouth.

The fan motor can provide rotational force. The fan motor may be a centrifugal fan or mixed-flow fan motor. The fan motor may be supported by a motor cover 162 that will be described below. In this case, a rotary shaft of the fan motor may extend downward from the fan motor and may pass through the lower surface of the motor cover 162. The hub 153 is coupled to the rotary shaft and can rotate with the rotary shaft. The shroud 154 may be spaced apart from the hub 153. A plurality of blades 155 may be disposed between the shroud 154 and the hub 153.

Accordingly, when the fan motor is driven, air can flow inside through the suction port in the axial direction of the fan motor (that is, the longitudinal direction of the rotary shaft) and can be discharged upward from the fan motor in the radial direction of the fan motor.

The air guide 160 can provide a channel 160P through which the air discharged from the fan 150 flows. For example, the channel 160P may be an annular channel. The air guide 160 may include a guide body 161, a motor cover 162, and a vane 163. Meanwhile, the air guide 160 may be referred to as a diffuser.

The guide body 161 may form the external shape of the air guide 160. The motor cover 162 may be disposed at the middle portion of the air guide 160. For example, the guide body 161 may be formed in a cylinder shape. Further, the motor cover 162 may be formed in a bowl shape. In this case, the annular channel 160P described above may be formed between the guide body 161 and the motor cover 162. The vane 163 can guide upward the air provided to the channel 160P from the fan 150. A plurality of vanes 163 may be disposed in the annular channel 160P and may be spaced apart from each other in the circumferential direction of the guide body 161. In this case, the plurality of vanes 163 each may extend to the inner circumferential surface of the guide body 161 from the outer surface of the motor cover 161.

A distribution unit 140 may be positioned over the air guide 160 and may be disposed between the lower body 110 and the upper bodies 120 and 130. The distribution unit 140 may provide a channel 140P through which air that has passed through the air guide 160 flows. The air that has passed through the air guide 160 can be distributed to the first upper body 120 and the second upper body 130 through the distribution unit 140. In other words, the air guide 160 guides flow, which flows by the fan 150, to the distribution unit 140 and the distribution unit 140 can guide the air flowing inside from the air guide 160 to the first upper body 120 and the second upper body 130. The groove 141 (see FIG. 1) described above can form a portion of the outer surface of the distribution unit 140. Meanwhile, the distribution unit may be referred to a middle body, an inner body, or a tower base.

For example, the first upper body 120 and the second upper body 130 may be left-right symmetric.

The first upper body 120 may provide a first channel 120P (see FIG. 4) through which a portion of the air, which has passed through the air guide 160, flows. The first channel 120P may be formed in the internal space of the first upper body 120. The second upper body 130 may provide a second channel 130P (see FIG. 4) through which the other of the air, which has passed through the air guide 160, flows. The second channel 120P may be formed in the internal space of the second upper body 130. The first channel 120P and the second channel 130P may communicate with the channel 140P of the distribution unit 140 and the channel 160P of the air guide 160. For example, a heater that heats air when operating may be installed in each of the first channel 120P and the second channel 130P.

Meanwhile, a first rear vane 124 may be installed in the first upper body 120 and may be adjacent to a first rear slit 120S that will be described below. The first rear vane 124 can guide flow of air of the first upper body 120 to the first rear slit 120S. For example, the first rear vane 124 may include a plurality of first rear vanes spaced apart from each other along the first rear slit 120S. Further, a first front vane 123 may be installed in the first upper body 120 and may be adjacent to a first front slit 120H that will be described below. The first front vane 123 can guide flow of air of the first upper body 120 to the first front slit 120H. For example, the first front vane 123 may include a plurality of first front vanes spaced apart from each other along the first front slit 120H.

Meanwhile, a second rear vane 134 may be installed in the second upper body 130 and may be left-right symmetric with the first rear vane 124. Further, a second front vane 133 may be installed in the second upper body 130 and may be left-right symmetric with the first front vane 123.

Figure 3:
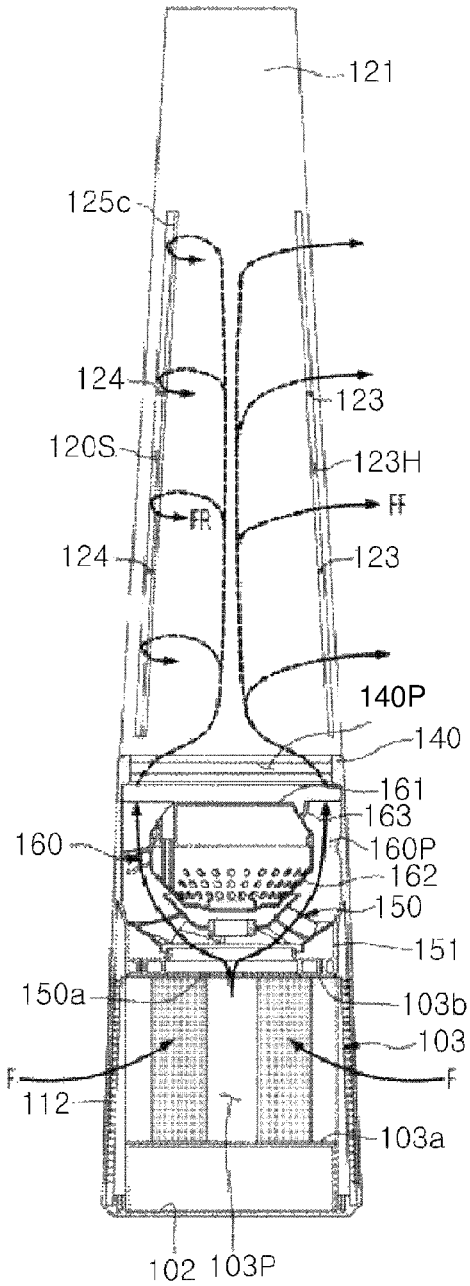
Figure 3:
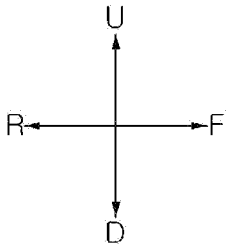
Figure 4:
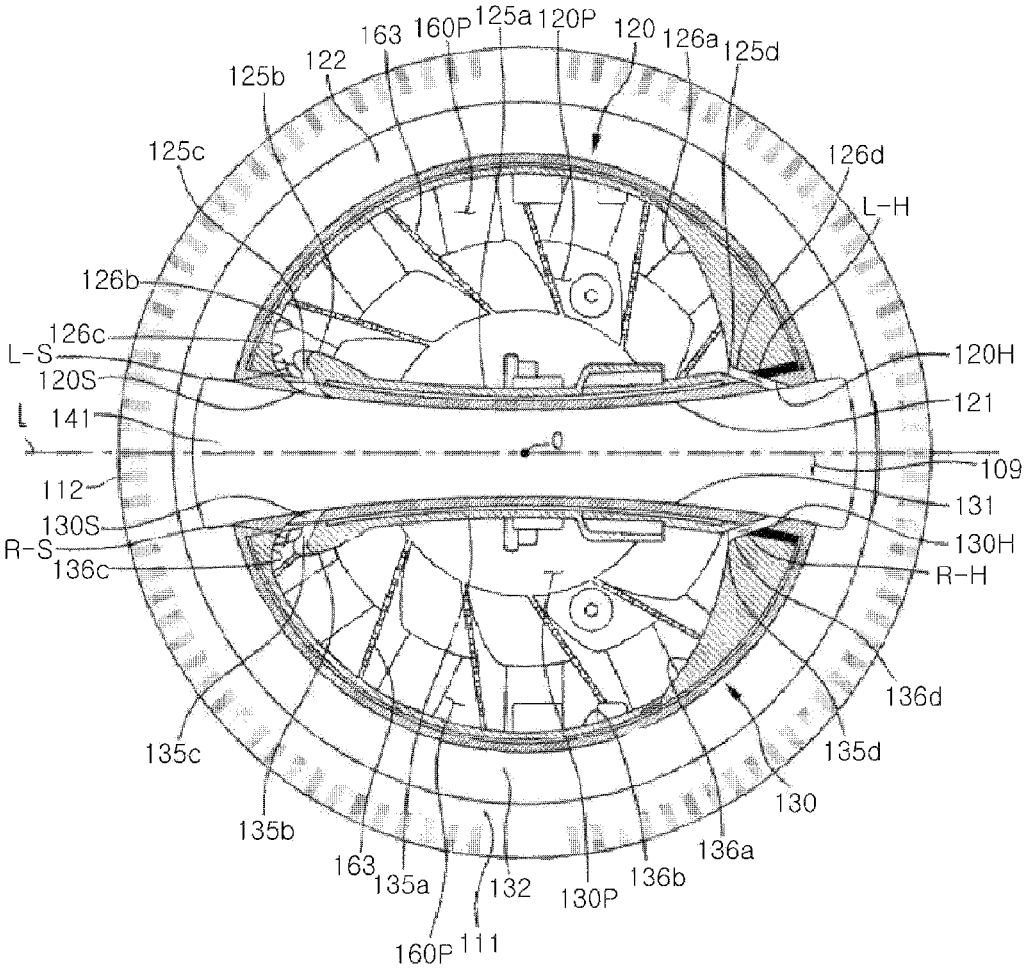
FIG. 4 is a cross-section taken along line II-II' of FIG. 1.
Figure 5:
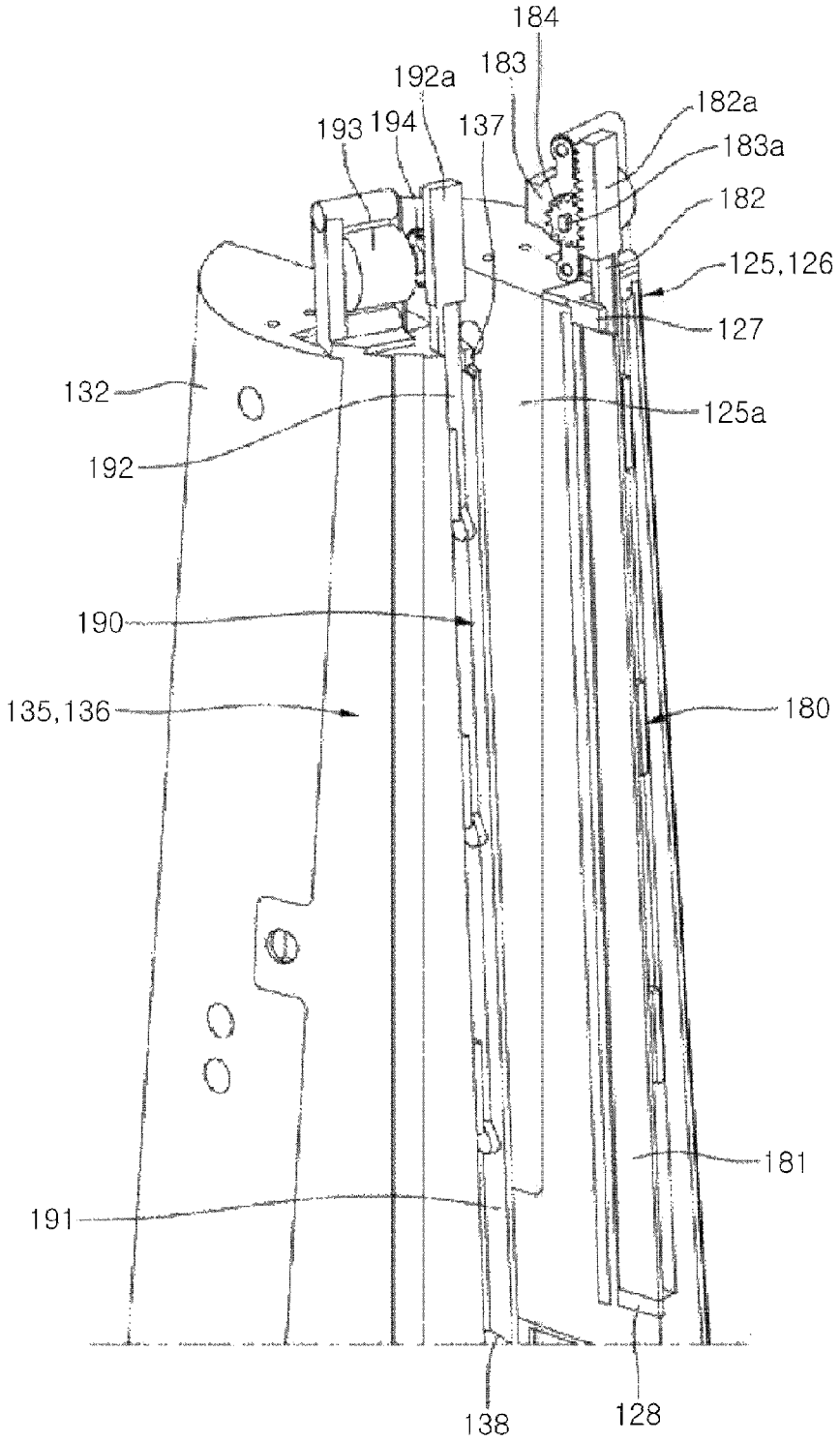
FIGS. 5 to 7 are views for describing a door assembly according to a first embodiment of the present disclosure.
Figure 6:
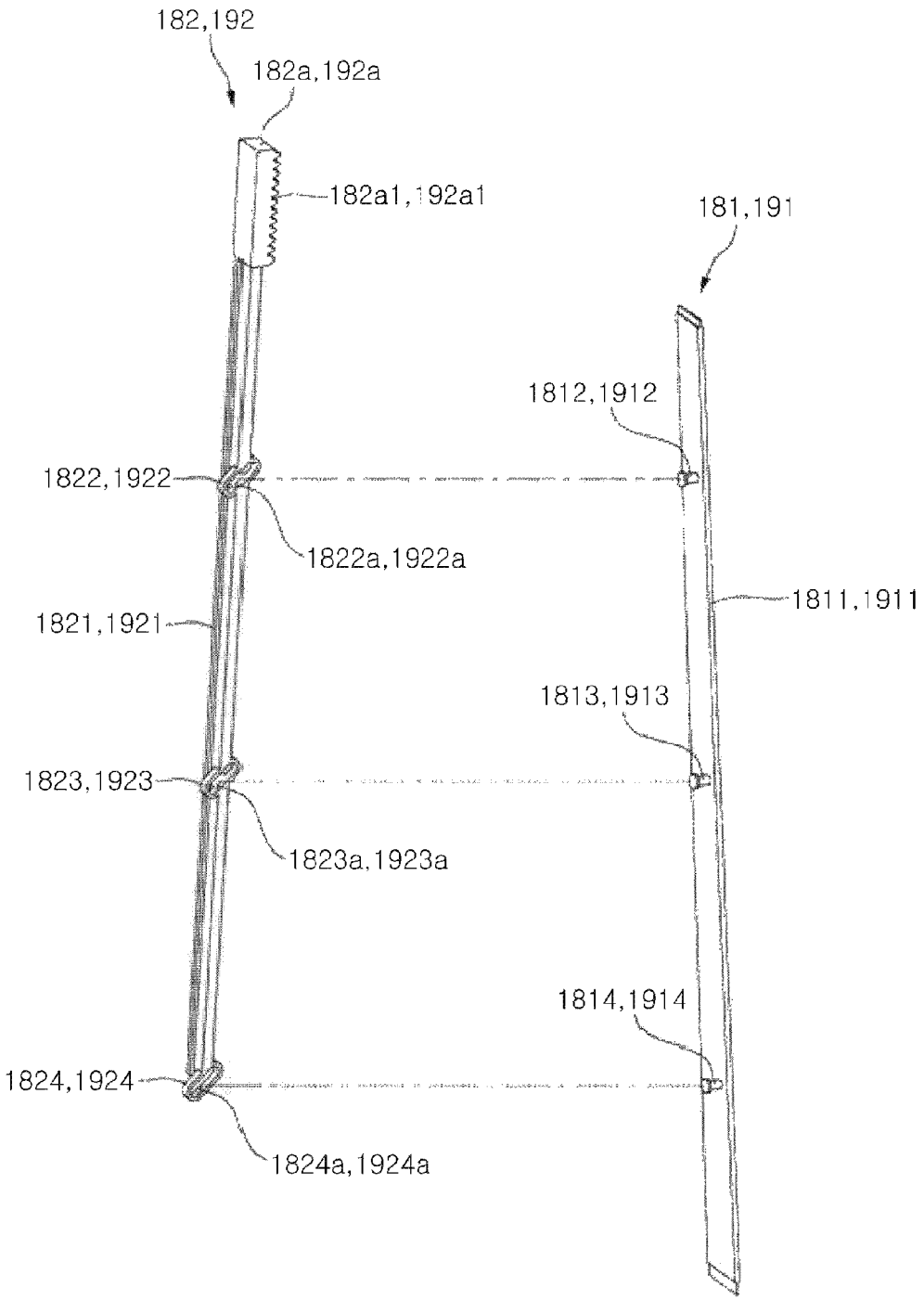

Referring to FIGS. 3 and 4, a central axis O extends in the up-down direction ac the center of the space 109 and the shape of the blower 100 may be symmetric with respect to the central axis O. A reference line L extends in the front-rear direction across the center axis O and a transverse surface of the blower 100 may be left-right symmetric with respect to the reference line L.

The first rear slit 120S is formed through the first inner panel 121 and can discharge air flowing through the first channel 120P to the space 109. The first rear slit 120S may be adjacent to the rear end 120R of the first upper body 120 and may be elongated along the rear end 120R. For example, the first rear slit 120S may be hidden from the gaze of a user who looks at the rear from ahead of the blower 100. Meanwhile, the first rear slit 120S may be referred to as a first rear hole.

The second rear slit 130S is formed through the second inner panel 131 and can discharge air flowing through the second channel 130P to the space 109. The second rear slit 130S may be adjacent to the rear end 130R of the second upper body 130 and may be elongated along the rear end 130R. For example, the second rear slit 130S may be hidden from the gaze of a user who looks at the rear from ahead of the blower 100. Meanwhile, the second rear slit 130S may be referred to as a second rear hole.

For example, the first rear slit 120S and the second rear slit 130S may be left-right symmetric while facing each other. For example, the first rear slit 120S may be provided as an outlet of a first opening L-O and the second rear slit 130S may be provided as an outlet of a second opening R-O.

A first inner sleeve 125, 126 is coupled to the inner surfaces of the first panels 121 and 122 and can define the boundary of the first channel 120P. One end and another end of the first inner sleeve 125, 126 are spaced apart from each other and the first opening L-O may be formed between one end and another end of the first inner sleeve 125, 126. Meanwhile, the first inner sleeve 125, 126 may be referred to as a first inner wall.

In detail, the first inner sleeve 125, 126 may include a first part 125 and a second part 126. The first part 125 may include a first extending portion 125*a* and a first discharge portion 125*b*, 125*c*. The second part 126 may include a second guide portion 126*a*, a second extending portion 126*b*, and a second discharge portion 126*c*.

The first extending portion 125*a* may be coupled to at least a portion of the inner surface (not provided with a reference numeral) of the first inner panel 121. The first extending portion 125*a* may extend along the inner surface. In this case, the first extending portion 125*a* may be formed convexly toward the surface of the first inner panel 121.

The first discharge portion 125*b*, 125*c* may make an acute angle with respect to the reference line L and may extend at an angle rearward from the first extending portion 125*a*. The thickness of the first discharge portion 125*b*, 125*c* may be larger than the thickness of the first extending portion 125*a*. The first discharge portion 125*b*, 125*c* may be formed substantially in an airfoil shape. The first discharge portion 125*b*, 125*c* may form an end of the first inner sleeve 125, 126.

In this case, the first discharge portion 125*b*, 125*c* may include a first guide surface 125*b* connected to the inner surface of the first extending portion 125*a* and defining the boundary of the first channel 120P together with the inner surface of the first extending portion 125*a*. The first discharge portion 125*b*, 125 may include a first discharge surface 125*c* bending from the first guide surface 125*b* and defining the boundary of the first opening L-O. The angle of the first guide surface 125*b* with respect to the reference line L may be smaller than the angle of the first discharge surface 125*c* with respect to the reference line L. For example, the first guide surface 125*b* and the first discharge surface 125*c* may be curved surfaces or flat surfaces.

The second guide portion 126*a* may be disposed ahead of the first extending portion 125*a* described above. The second guide portion 126*a* may be coupled to at least a portion of the inner surface (not provided with a reference numeral) of the first outer panel 122. The second guide portion 126*a* may extend along the inner surface. The second guide portion 126*a* may be formed convexly toward the surface of the first outer panel 122. The thickness of the second guide portion 126*a* may be larger than the thickness of the first extending portion 125*a* and may decrease away from the first inner panel 121. The second guide portion 126*a* may be formed substantially in a fin shape. For example, a portion of the second guide portion 126*a* may be coupled to a portion of the inner surface (not provided with a reference numeral) of the first inner panel 121 and may be in contact with or coupled to the first extending portion 125*a*.

The second extending portion 126*b* may extend from the second guide portion 126*a* and may be coupled to a portion of the inner surface (not provided with a reference numeral) of the first outer panel 122. The second extending portion 126*b* may extend along the inner surface. The second extending portion 126*b* may be formed convexly toward the surface of the first outer panel 122. The thickness of the second extending portion 126*b* may be smaller than the thickness of the second guide portion 126*a* and may be the same as or similar to the thickness of the first extending portion 125*a*. In this case, the inner surface of the second extending portion 126*b* can define the boundary of the first channel 120P together with the inner surface of the second guide portion 126*a*.

The second discharge portion 126*c* may extend from the second extending portion 126*b* and may be coupled to a portion of the inner surface (not provided with a reference numeral) of the first inner panel 121. The thickness of the second discharge portion 126*c* may be larger than the thickness of the second extending portion 126*b*. The second discharge portion 126*c* may form another end of the first inner sleeve 125, 126.

In this case, the inner surface of the second discharge portion 126*c* is connected to the inner surface of the second extending portion 126*b* and can define the boundary of the first opening L-O. In other words, the inner surface of the second discharge portion 126*c* faces the first discharge surface 125*c* and the first opening L-O may be formed between the inner surface of the second discharge portion 126*c* and the first discharge surface 125*c*. Further, the outlet of the first opening L-O may be provided as the first rear slit 120S described above. Meanwhile, the inner surface of the second discharge portion 126*c* may be referred to as a second discharge surface.

Accordingly, the air flowing through the first channel 120P can be provided to the space 109 through the first opening L-O and the first rear slit 120S. In this case, the first inner sleeve 125, 126 can smoothly guide the air flowing through the first channel 120P to the first opening L-O while forming the boundary of the first channel 120P.

A second inner sleeve 135, 136 is coupled to the inner surface of the inner surface of the second upper body 130 and can define the boundary of the second channel 130P. One end and another end of the second inner sleeve 135, 136 are spaced apart from each other and the second opening R-O may be formed between one end and another end of the second inner sleeve 135, 136. Meanwhile, the second inner sleeve 135, 136 may be referred to as a second inner wall.

In detail, the second inner sleeve 135, 136 may include a first part 135 and a second part 136. The first part 135 may include a first extending portion 135*a* and first discharge portions 135*b* and 135*c*. The second part 136 may include a second guide portion 136*a*, a second extending portion 136*b*, and a second discharge portion 136*c*.

The first extending portion 135*a* may be coupled to at least a portion of the inner surface (not provided with a reference numeral) of the second inner panel 131. The first extending portion 135*a* may extend along the inner surface. In this case, the first extending portion 135*a* may be formed convexly toward the surface of the second inner panel 131.

The first discharge portion 135*b*, 135*c* may make an acute angle with respect to the reference line L and may extend at an angle rearward from the first extending portion 135*a*. The thickness of the first discharge portion 135*b*, 135*c* may be larger than the thickness of the first extending portion 135*a*. The first discharge portion 135*b*, 135*c* may be formed substantially in an airfoil shape. The first discharge portion 135*b*, 135*c* may form an end of the second inner sleeve 135, 136.

In this case, the first discharge portion 135*b*, 135*c* may include a second guide surface 135*b* connected to the inner surface of the first extending portion 135*a* and defining the boundary of the second channel 130P together with the inner surface of the first extending portion 135*a*. The first discharge portion 135*b*, 135*c* may include a first discharge surface 135*c* bending from the first guide surface 135*b* and defining the boundary of the second opening R-O. The angle of the first guide surface 135*b* with respect to the reference line L may be smaller than the angle of the first discharge surface 135*c* with respect to the reference line L. For example, the first guide surface 135*b* and the first discharge surface 135*c* may be curved surfaces or flat surfaces.

The second guide portion 136*a* may be disposed ahead of the first extending portion 135*a* described above. The second guide portion 136*a* may be coupled to at least a portion of the inner surface (not provided with a reference numeral) of the second outer panel 132. The second guide portion 136*a* may extend along the inner surface. The second guide portion 136*a* may be formed convexly toward the surface of the second outer panel 132. The thickness of the second guide portion 136*a* may be larger than the thickness of the first extending portion 135*a* and may decrease away from the second inner panel 131. The second guide portion 136*a* may be formed substantially in a fin shape. For example, a portion of the second guide portion 136*a* may be coupled to a portion of the inner surface (not provided with a reference numeral) of the second inner panel 131 and may be in contact with or coupled to the first extending portion 135*a*.

The second extending portion 136*b* may extend from the second guide portion 136*a* and may be coupled to a portion of the inner surface (without a reference numeral) of the second outer panel 132. The second extending portion 136*b* may extend along the inner surface. The second extending portion 136*b* may be formed convexly toward the surface of the second outer panel 132. The thickness of the second extending portion 136*b* may be smaller than the thickness of the second guide portion 136*a* and may be the same as or similar to the thickness of the first extending portion 135*a*. In this case, the inner surface of the second extending portion 136*b* can define the boundary of the second channel 130P together with the inner surface of the second guide portion 136*a*.

The second discharge portion 136*c* may extend from the second extending portion 136*b* and may be coupled to a portion of the inner surface (not provided with a reference numeral) of the second inner panel 131. The thickness of the second discharge portion 136*c* may be larger than the thickness of the second extending portion 136*b*. The second discharge portion 136*c* may form another end of the second inner sleeve 135, 136.

In this case, the inner surface of the second discharge portion 136*c* is connected to the inner surface of the second extending portion 136*b* and can define the boundary of the second opening R-O. In other words, the inner surface of the second discharge portion 136*c* faces the first discharge surface 135*c* and the second opening R-O may be formed between the inner surface of the second discharge portion 136*c* and the first discharge surface 135*c*. Further, the outlet of the second opening R-O may be provided as the second rear slit 130S described above. Meanwhile, the inner surface of the second discharge portion 136*c* may be referred to as a second discharge surface.

Accordingly, the air flowing through the second channel 130P can be provided to the space 109 through the second opening R-O and the second rear slit 130S. In this case, the second inner sleeve 135, 136 can smoothly guide the air flowing through the second channel 130P to the second opening R-O while forming the boundary of the second channel 130P.

The first opening L-O and the second opening R-O described above may communicate with the space 109 and may face each other.

The air that has passed through the first channel 120P can be provided to the inlet of the first opening L-O and can be discharged to the first rear slit 120S that is the outlet of the first opening L-O. In this case, the inlet of the first opening L-O may be positioned in the internal space of the first upper body 120 forming the first channel 120P. The first opening L-O may be formed to incline or bend forward toward the space 109. For example, the first opening L-O may be formed to incline or bend toward the front of the second opening R-O.

The air that has passed through the second channel 130P can be provided to the inlet of the second opening R-O and can be discharged to the second rear slit 130S that is the outlet of the second opening R-O. In this case, the inlet of the second opening R-O may be positioned in the internal space of the second upper body 130 forming the second channel 130P. The second opening R-O may be formed to incline or bend forward toward the space 109. For example, the second opening R-O may be formed to incline or bend toward the front of the first opening L-O.

Meanwhile, the first front slit 120H is formed through the first inner panel 120 and can discharge air flowing through the first channel 120P to the space 109. The first front slit 120H may be adjacent to the front end 120F of the first upper body 120 and may be elongated along the front end 120F. For example, the first front slit 120H may be hidden from the gaze of a user who looks at the front from behind the blower 100. Meanwhile, the first front slit 120H may be referred to as a first front hole.

The first front slit 120H may be provided as the outlet of the first slot L-H. In this case, the first slot L-H may be formed through the first inner panel 121 and the second guide portion 126*a*. The first slot L-H may make an acute angle with respect to the reference line L and may extend to inclined rearward from the first inner panel 121. Portions 125*d* and 126*d* of the second guide portion 126*a* diagonally extend and can form the boundary of the first slot L-H. The inlet of the first slot L-H may be positioned in the internal space of the first upper body 120 forming the first channel 120P. The first slot L-H may be formed to incline or bend forward toward the front of the space 109.

The second front slit 130H is formed through the second inner panel 131 and can discharge air flowing through the second channel 130P to the space 109. The second front slit 130H may be adjacent to the front end 130F of the second upper body 130 and may be elongated along the front end 130F. For example, the second front slit 130H may be hidden from the gaze of a user who looks at the front from behind the blower 100. Meanwhile, the second front slit 130H may be referred to as a first front hole.

The second front slit 130H may be provided as the outlet of the second slot R-H. In this case, the second slot R-H may be formed through the second inner panel 131 and the second guide portion 136*a*. The second slot R-H may make an acute angle with respect to the reference line L and may extend to inclined rearward from the second inner panel 131. Portions 135*d* and 146*d* of the second guide portion 136*a* diagonally extend and can form the boundary of the second slot R-H. The inlet of the second slot R-H may be positioned in the internal space of the second upper body 130 forming the second channel 130P. The second slot R-H may be formed to incline or bend forward toward the front of the space 109.

Accordingly, air flowing by the fan 150 can be distributed to the first channel 120P and the second channel 130P. Further, a portion of the air of the first channel 120P can be discharged to the space 109 through the first rear slit 120S (see FR) and the other can be discharged to the space 109 through the first front slit 120H (see FF).

Figure 7:
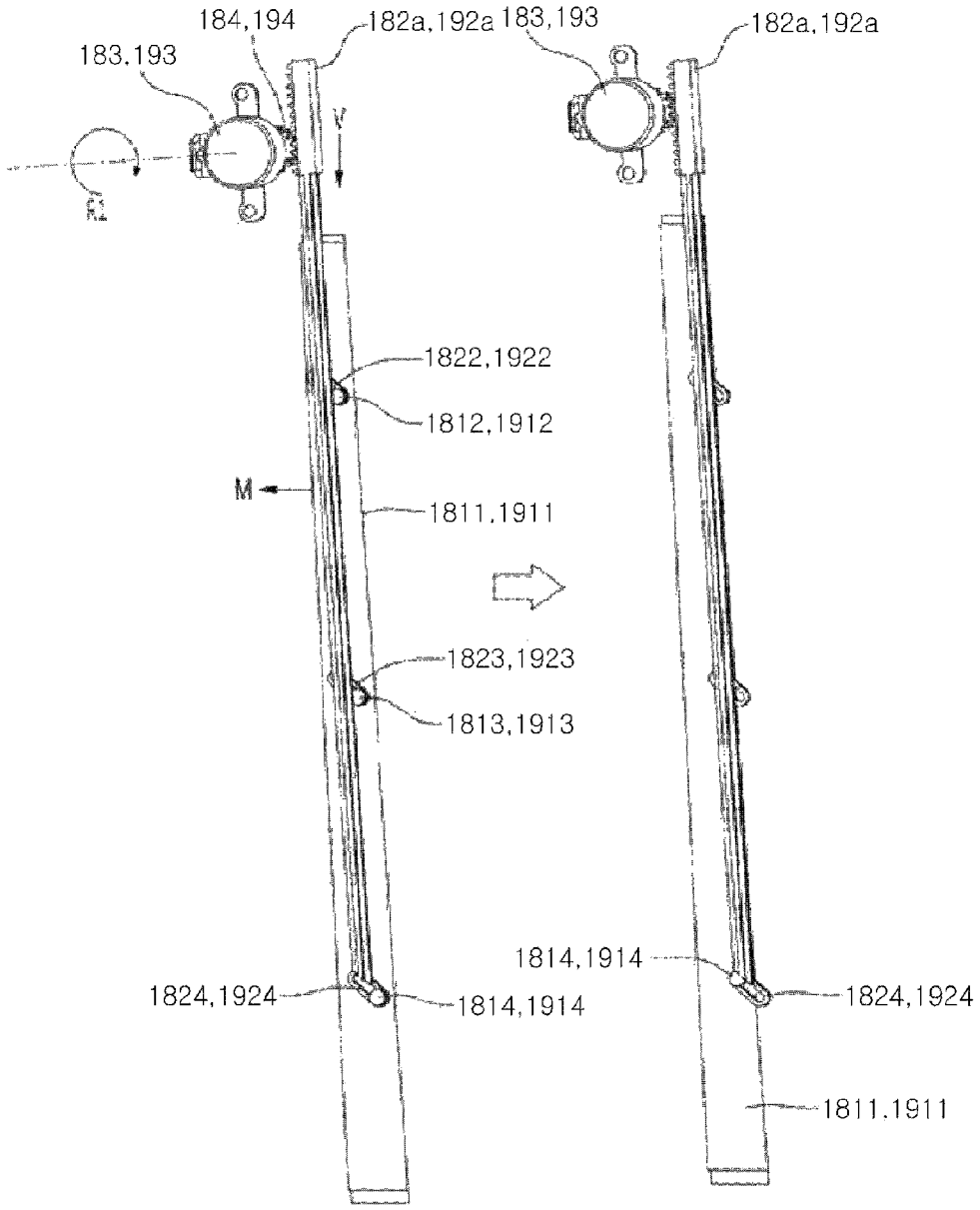
Figure 15:
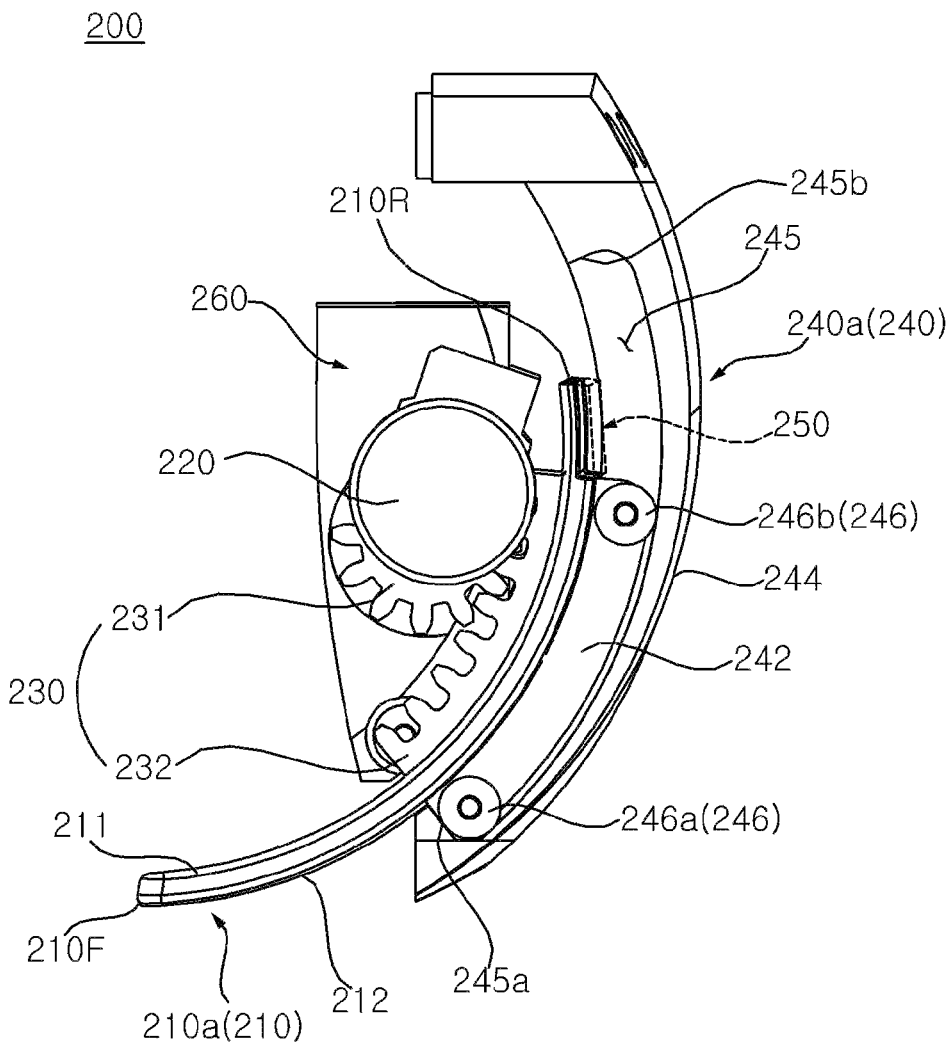

Referring to FIGS. 15 to 7, the door assemblies 180, 190 are installed at the first upper body 120 and the second upper body 130 and can open of close the rear slits 120S and 130S and/or the front slits 120H and 130H. That is, the first door assembly 180 is installed at the first upper body 120 and can open and close the rear slit 120S and/or the first front slit 120H and the second door assembly 190 is installed at the second upper body 130 and can open and close the second rear slit 130S and/or the second front slit 130H. Hereafter, for brief description, the case in which the door assemblies 180 and 190 open and close the front slits 120H and 130H is described.

For example, the first door assembly 180 and the second door assembly 190 may be left-right symmetric. Hereafter, for brief description, the first door assembly 180 is described and this description can be equally applied to the second door assembly 190.

The first door assembly 180 may be installed at the first inner sleeve 125, 126 and disposed in the internal space of the first upper body 120. The first door assembly 180 may include a first door 181, a first link 182, a first motor 183, and a first pinion 184. Further, the first door 181 may include a first door plate 1811 and a first door pin 1812, 1813, 1814.

The first door plate 1811 may be elongated in the longitudinal direction of the first front slit 120H. The surface of the first door plate 1811 that faces the space 109 may be a curved surface having the same curvature as the surface of the first inner panel 121 (see FIG. 4). In this case, the first door plate 1811 may be provided to be able to move in the circumferential direction of the first door plate 1811. For example, the area of the first door plate 1811 may be larger than the size of the first slot L-H. For example, the rear surface of the first door plate 1811 may be formed to incline equally to the portion that is the portion 125*d* of the second guide portion 126*a* and inclined toward the front of the space 109.

Accordingly, when the first door 181 closes the first front slit 120H, the rear surface of the first door plate 1811 can come in contact with the portion 125*d* of the second guide portion 126*a* that forms a portion of the boundary of the first slot L-H. Further, when the first door 181 opens the first front slit 120H, the rear surface of the first door plate 1811 is separated from the portion 125*d* of the second guide portion 126*a*, which forms a portion of the boundary of the first slot L-H, and is disposed in parallel with the portion 125*d*, so air resistance can be minimized.

The first door pin 1812, 1813, 1814 may protrude to the inner space of the first upper body 120 from the inner surface opposite to the surface of the first door plate 1811 that faces the space 109. The first door pin 1812, 1813, 1814 may be formed entirely in bolt shapes. In this case, the diameters of the end of the first door pin 1812, 1813, 1814 may be larger than the diameter of the portion positioned between the end and the first door plate 1811.

For example, the first door pin 1812, 1813, 1814 may include a plurality of first door pins 1812, 1813, and 1814 spaced apart from each other in the longitudinal direction of the first door plate 1811. In this case, the first door pin 1812 may be adjacent to the upper end of the first door plate 1811, and the third door pin 1814 may be adjacent to the lower end of the first door plate 1811, and the second door pin 1813 may be disposed between the first door pin 1812 and the third door pin 1814.

The first link 182 may be coupled to the first door 181. The first link 182 may include a first link stick 1812, a first rack 182*a*, and a first door guide 1822, 1823, 1824.

The first link stick 1812 may be elongated in the longitudinal direction of the first door plate 1811. The first link stick 1812 may face the inner surface of the first door plate 1811 at which the first door pin 1812, 1813, 1814 is formed.

The first rack 182*a* may be coupled to the upper end of the first link stick 1821. The width of the first rack 182*a* may be larger than the width of the first link stick 1821. First gear teeth 182*a*1 may be formed on a side of the first rack 182*a*. The first gear teeth 182*a*1 may be elongated in the longitudinal direction of the first link stick 1821.

The first door guide 1822, 1823, 1824 may be provided on a side of the first link stick 1821 that faces the inner surface of the first door plate 1811. The first door guide 1822, 1823, 1824 may be elongated in a direction crossing the longitudinal direction of the first link stick 1821. The first door guide 1822, 1823, 1824 can guide movement of the first door pin 1812, 1813, 1814 while facing or corresponding to the first door pin 1812, 1813, 1814. The first door guide 1822, 1823, 1824 may include a first guide groove 1822*a*, 1823*a*, 1824*a* formed through the first door guide 1822, 1823, 1824 and elongated in the longitudinal direction of the first door guide 1822, 1823, 1824. The first guide groove 1822*a*, 1823*a*, 1824*a* may be a track shape. In this case, the first door pin 1812, 1813, 1814 may be inserted in the first guide groove 1822*a*, 1823*a*, 1824*a* to be movable in the longitudinal direction of the first door guide 1822, 1823, 1824.

For example, the first door guide 1822, 1823, 1824 may include a plurality of first door guides 1822, 1823, and 1824 spaced apart from each other in the longitudinal direction of the first link stick 1821. In this case, the first door pin 1812 may be movably coupled to the first door guide 1822, the second door pin 1813 may be movably coupled to the second guide 1823, and the third door pin 1814 may be movably coupled to the third guide 1824.

For example, the end of the first door pin 1812, 1813, 1814 may be locked to the first door guide 1822, 1823, 1824 between the first link stick 1821 and the first door guide 1822, 1823, 1824. In this case, the portion of the first door guide 1822, 1823, 1824 to which the end of the first door pin 1812, 1813, 1814 is locked may be a curved surface having the same curvature as the first inner panel 121 (see FIG. 4). Further, the portion of the end of the first door pin 1812, 1813, 1814 that is locked to the first door guide 1822, 1823, 1824 may be a curved surface having the same curvature as the first inner panel 121 (see FIG. 4). Accordingly, the first door plate 1811 may be provided to be able to move in the circumferential direction of the first door plate 1811.

The first motor 183 can provide power to the first door 181. The first motor 183 may be a step motor. For example, the first motor 183 may be installed over the first inner sleeve 125, 126 and disposed in the internal space of the first upper body 120.

The first pinion 184 is coupled to the rotary shaft of the first motor 183 and can rotate with the rotary shaft of the first motor 183. The first pinion 184 may be engaged with the first gear teeth 182*a* of the first rack 812. Accordingly, when the first motor 183 is driven, the first rack 182 can be moved in the longitudinal direction of the first link stick 1821 (see FIG. 7).

That is, when the first motor 183 is rotated in a first direction (e.g.: clockwise), the first rack 182 and the first link stick 1821 can be moved toward the lower end from the upper end of the first link stick 1821. When the first motor 183 is rotated in the opposite direction to the first direction (e.g.: counterclockwise), the first rack 182 and the first link stick 1821 can be moved toward the upper end from the lower end of the first link stick 1821. Further, in correspondence to such movement of the first link stick 1821, the first door pin 1812, 1813, 1814 and the first door plate 1822 can be moved in the circumferential direction of the first door plate 1811 by guide of the first door guide 1822, 1823, 1824.

The first upper guide 127 can form the upper boundary of the first front slit 120H. The first upper guide 127 is coupled to the upper end of the first door plate 1811 and can guide movement of the first door 181. The first upper guide 127 may cover a portion of the upper end of the first door plate 1811 and the upper end of the first door plate 1811 may be movably inserted in a groove formed at a lower portion of the first upper guide 127. The surface and the groove of the first upper guide 127 may be curved surfaces or grooves having the same curvature as the surface of the first inner panel 121 (see FIG. 4).

In this case, the width of the upper end of the first door plate 1811 may be smaller than the width of the center portion of the first door plate 1811. Accordingly, the upper end of the first door plate 1811 can be easily inserted in the groove of the first upper guide 127.

The first lower guide 128 can form the lower boundary of the first front slit 120H. The first lower guide 128 is coupled to the lower end of the first door plate 1811 and can guide movement of the first door 181. The first lower guide 128 may cover a portion of the lower end of the first door plate 1811 and the lower end of the first door plate 1811 may be movably inserted in a groove formed at an upper portion of the first lower guide 128. The surface and the groove of the first lower guide 128 may be curved surfaces or grooves having the same curvature as the surface of the first inner panel 121 (see FIG. 4).

In this case, the width of the lower end of the first door plate 1811 may be smaller than the width of the center portion of the first door plate 1811. Accordingly, the lower end of the first door plate 1811 can be easily inserted in the groove of the first lower guide 128.

Meanwhile, the controller can control components of the blower 100 that are connected to the controller such as the fan 150, the first door assembly 180, the second door assembly 190, etc. on the basis of input by a user, etc.

Figure 8:
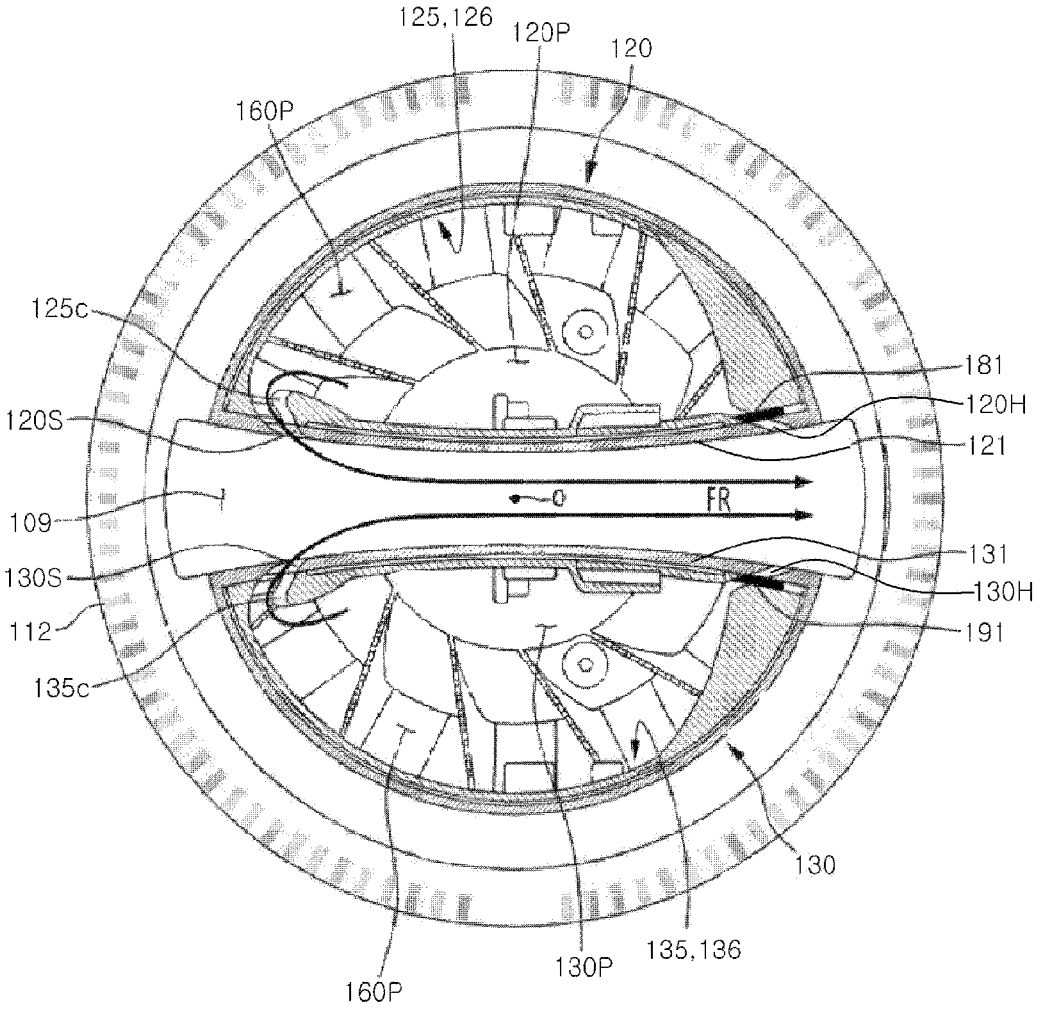
FIGS. 8 and 9 are views for describing indirect wind formed by when a door assembly according to the first embodiment closes a front slit.
Figure 9:
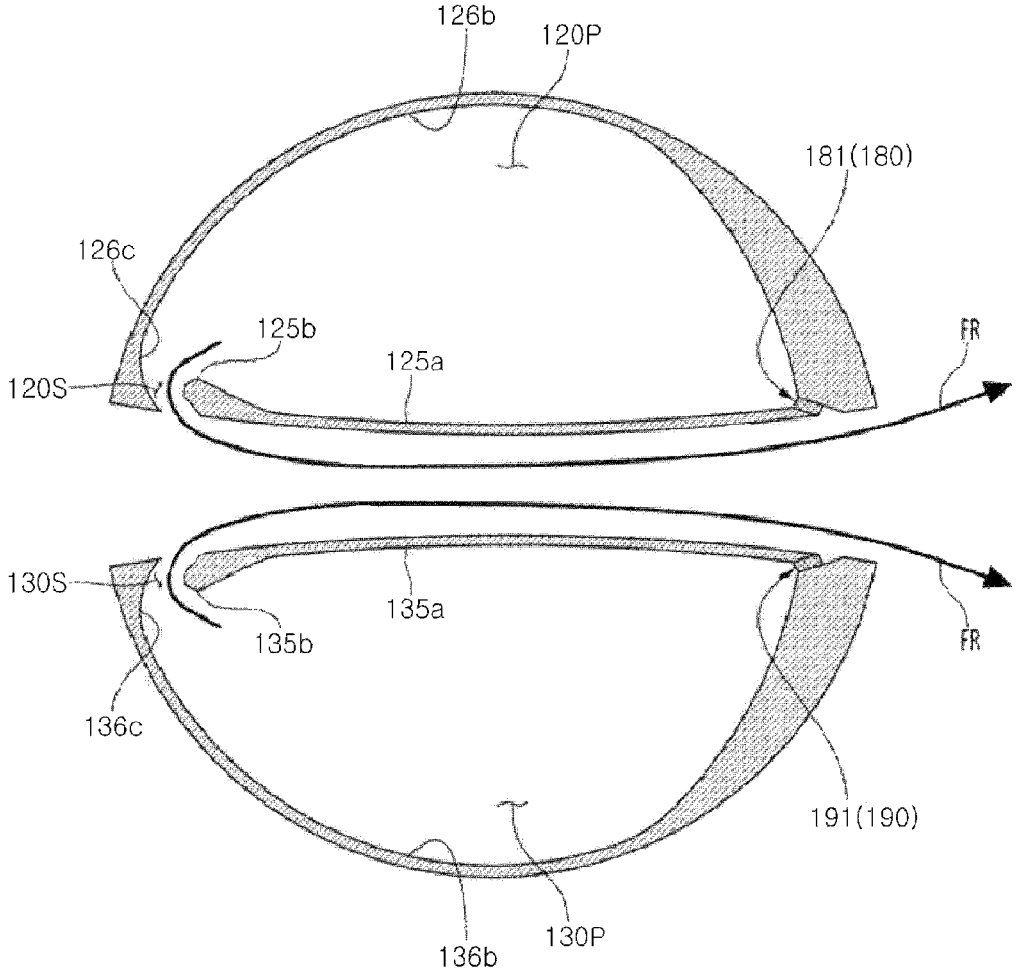

Referring to FIGS. 8 and 9, the controller can move down the first link stick 1821 and the second link stick 191 by controlling rotational operations of the first motor 183 of the first door assembly 180 and the second motor 193 of the second door assembly 190 (see V of FIG. 7). In correspondence to this, the first door 181 and the second door 191 can be moved rearward in the circumferential direction of the inner panel 121, 131 (see M of FIG. 7).

In this case, the first door 181 can close the first front slit 120H and the second door 191 can close the second front slit 130H.

The air of the first channel 120P can be discharged to the space 109 through the first rear slit 120S. The air of the second channel 130P can be discharged to the space 109 through the second rear slit 130S. Further, due to Coanda effect, the air discharged to the space 109 can flow forward along the surface of the first inner panel 121 and the surface of the second inner panel 131 (see FR of FIGS. 8 and 9). In this case, the gap between the surface of the first inner panel 121 and the surface of the second inner panel 131 may be narrowed toward the center portion from the rear portion of the space 109 and may be widened toward the front portion of the space 109 from the center portion.

Accordingly, the air of the space 109 can flow forward while widely spreading left and right. Meanwhile, this airflow may be referred to as diffusive wind or indirect wind.

Further, such flow of air can form airflow in which the air around the upper bodies 120 and 130 is entrained into the space 109 or flows forward along the surfaces of the outer panels 122 and 132. As a result, the blower 100 can provide a sufficient amount of airflow to a user, etc.

Figure 10:
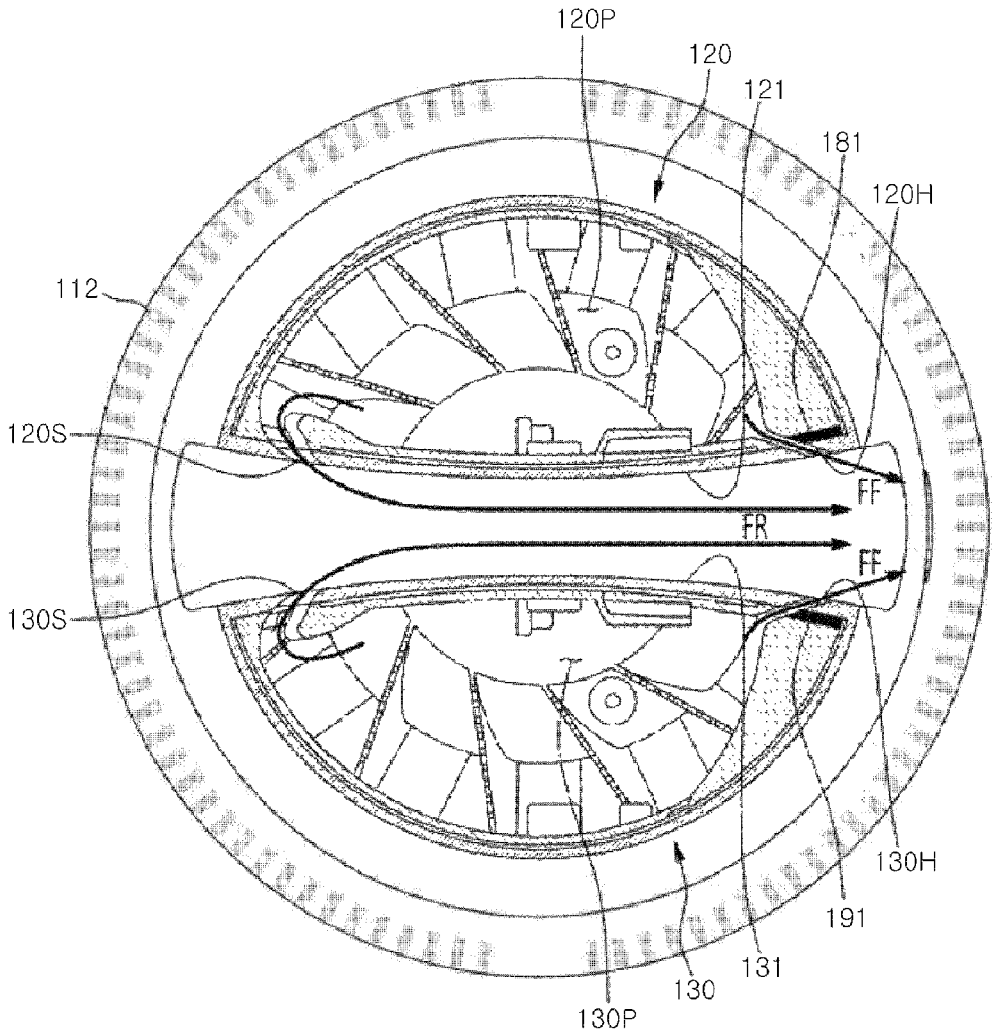
FIGS. 10 and 11 are views for describing indirect wind formed when the door assembly according to the first embodiment opens the front slit.
Figure 11:
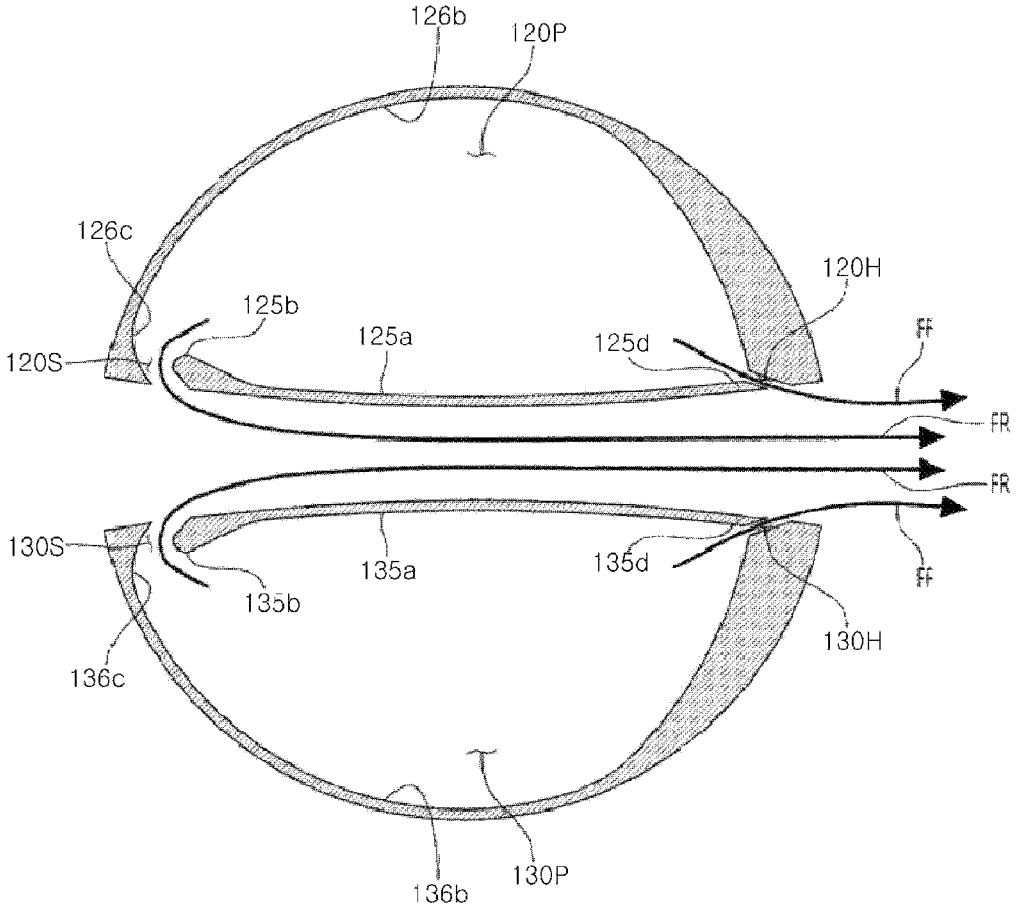

Referring to FIGS. 10 and 11, the controller can move up the first link stick 1821 and the second link stick 191 by controlling rotational operations of the first motor 183 of the first door assembly 180 and the second motor 193 of the second door assembly 190. In correspondence to this, the first door 181 and the second door 191 can be moved forward in the circumferential direction of the inner panel 121, 131.

In this case, the first door 181 can open the first front slit 120H and the second door 191 can open the second front slit 130H.

The air of the first channel 120P can be discharged to the space 109 through the first rear slit 120S and the first front slit 120H. The air of the second channel 130P can be discharged to the space 109 through the second rear slit 130S and the second front slit 130H. Further, due to Coanda effect, the air discharged to the space 109 from the first rear slit 120S and the second rear slit 130S can flow forward along the surface of the first inner panel 121 and the surface of the second inner panel 131 (see FR of FIGS. 10 and 11). Further, the air that is discharged from the first front slit 120H and the second front slit 130H can concentrate air, which flows along the surface of the first inner panel 121 and the surface of the second inner panel 131, to the reference line L (see FIG. 4) (see FF of FIGS. 10 and 11).

Accordingly, the air of the space 109 can intensively flow forward. Meanwhile, this airflow may be referred to as intensive wind or indirect wind.

Further, such flow of air can form airflow in which the air around the upper bodies 120 and 130 is entrained into the space 109 or flows forward along the surfaces of the outer panels 122 and 132. As a result, the blower 100 can provide a sufficient amount of airflow to a user, etc.

Meanwhile, the controller can adjust the degrees of opening of the first front slit 120H and the second front slit 130H by controlling rotational operations of the first motor 183 of the first door assembly 180 and the second motor 193 of the second door assembly 130. That is, as the degrees of opening of the first front slit 120H and the second front slit 130H decrease, the intensity of the intensive wind may decrease.

For example, the controller can equally adjust the degrees of opening of the first front slit 120H and the second front slit 130H by synchronizing rotational operations of the first motor 183 of the first door assembly 180 and the second motor 193 of the second door assembly 130.

As another example, the controller can differently adjust the degrees of opening of the first front slit 120H and the second front slit 130H by differently controlling rotational operations of the first motor 183 of the first door assembly 180 and the second motor 193 of the second door assembly 130. When the degree of opening of the first front slit 120H is larger than the degree of opening of the second front slit 130H, the blower 100 can provide airflow biased to the right to a user, etc. When the degree of opening of the first front slit 120H is smaller than the degree of opening of the second front slit 130H, the blower 100 can provide airflow biased to the left to a user, etc.

Figure 12:
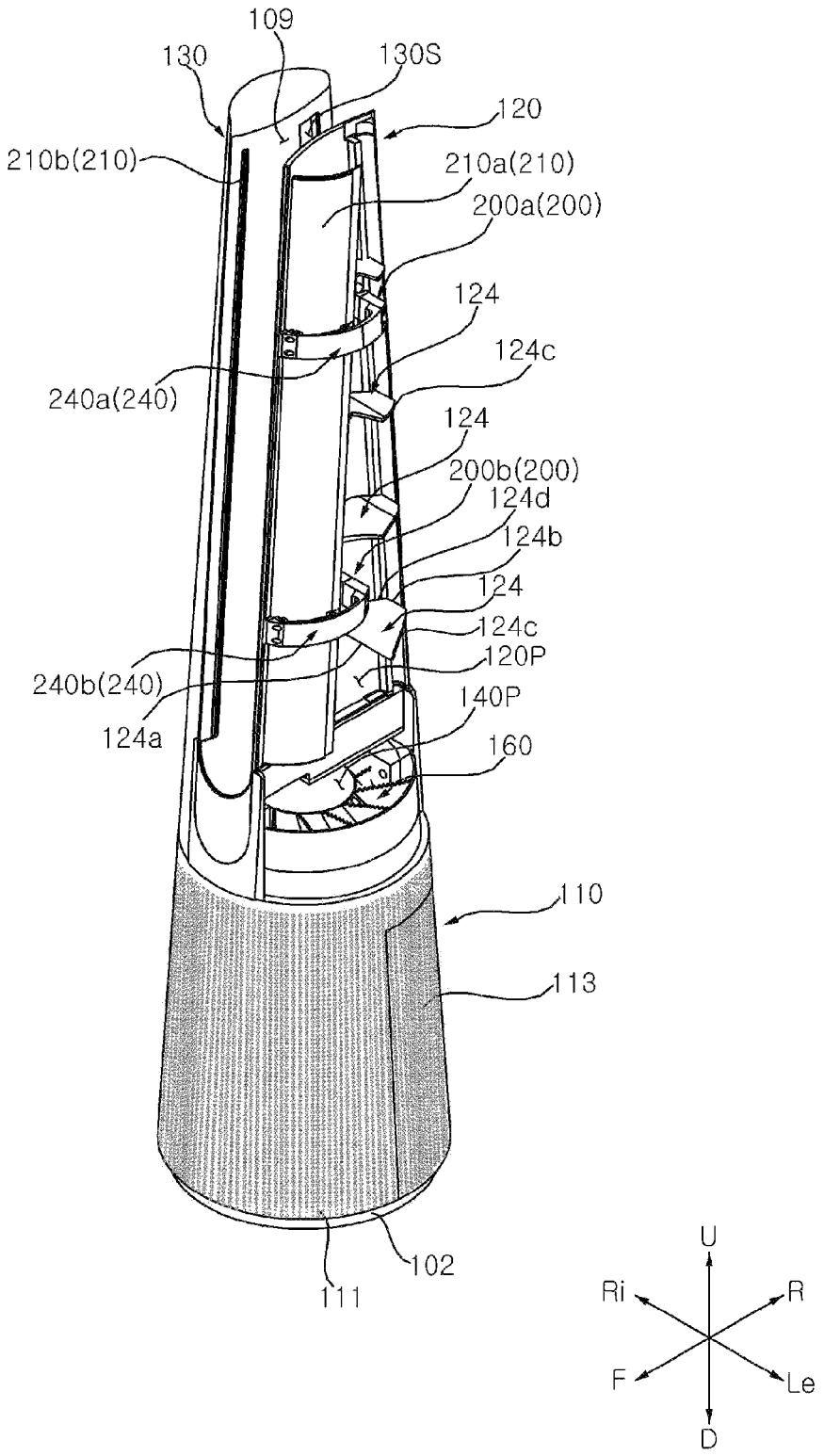
FIG. 12 is a view showing an internal configuration of a blower having a door assembly according to a second embodiment of the present disclosure.
Figure 13:
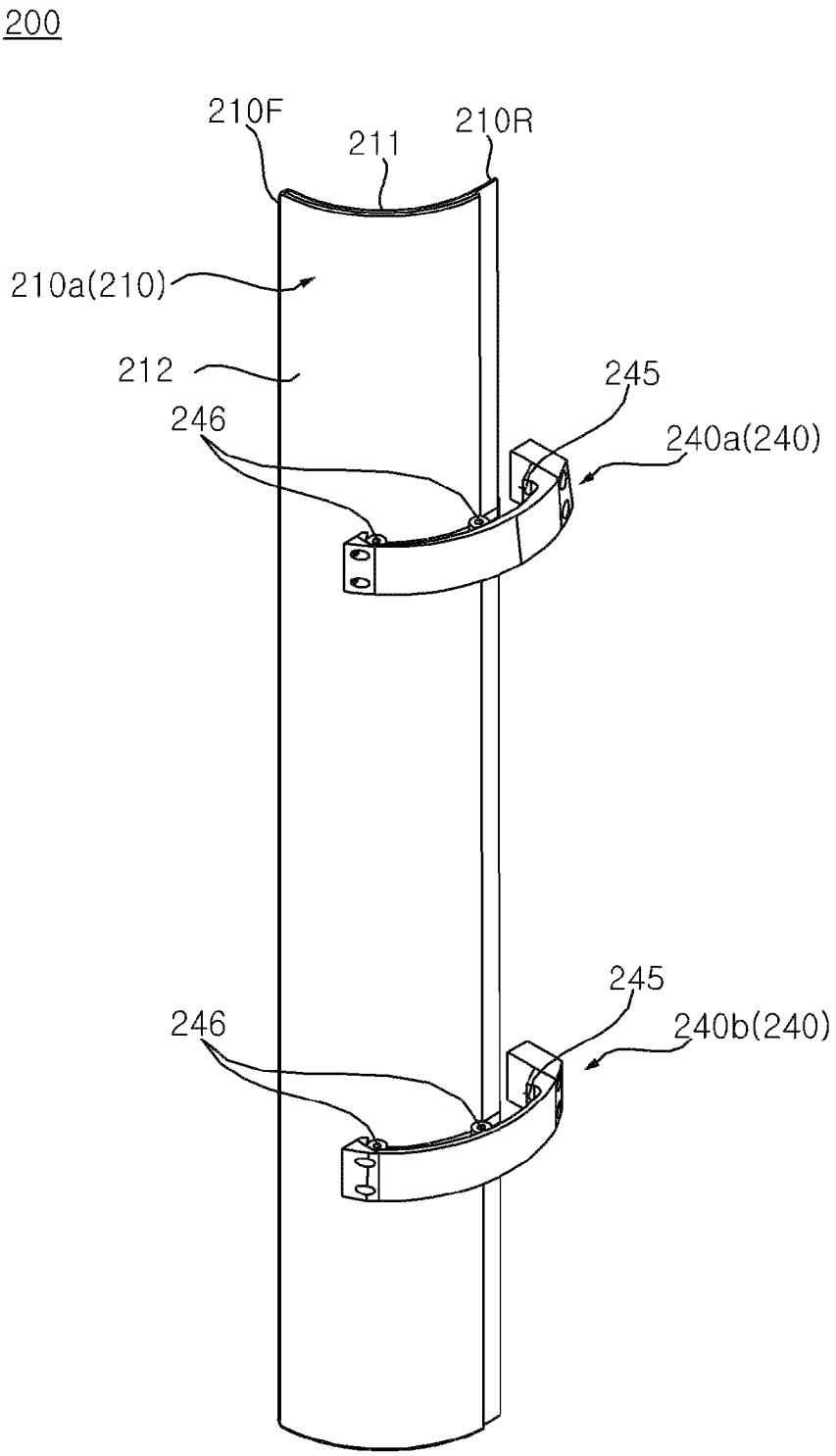
FIGS. 13 to 16 are views for describing the door assembly according to the second embodiment of the present disclosure.

Referring to FIGS. 12 and 13, a door assembly 200 including a door 210 may be installed at upper bodies 120 and 130. The door assembly 200 may include a first door assembly 200*a* installed at the first upper body 120 and including a first door 210*a* and a second door assembly 200*b* (not shown) installed at the second upper body 130 and including a second door 210*b*. The first door assembly 200*a* and the second door assembly 200*b* may be left-right symmetric. Meanwhile, the door assembly 200 may be referred to as an air flow converter.

The door assembly 200 may include the door 210 and the door guide 240 described above. The door 210 may be formed to be flat or curved. For example, the door 210 may be a plate that is convex to the outside. In this case, the door 210 may extend while drawing an arc having a predetermined curvature with respect to the center positioned inside the inner surface 211. A front end 210F of the door 210 may pass through the front slits 120H and 130H. The door guide 240 is coupled to the outer surface 212 of the door 210 and can guide movement of the door 210. For example, the door guide 240 may include a first door guide 240*a* and a second door guide 240*b* that are spaced apart from each other in the up-down direction and have the same configuration.

Meanwhile, the door 210 may be referred to as a board and the door guide 240 may be referred to as a board guide.

Figure 14:
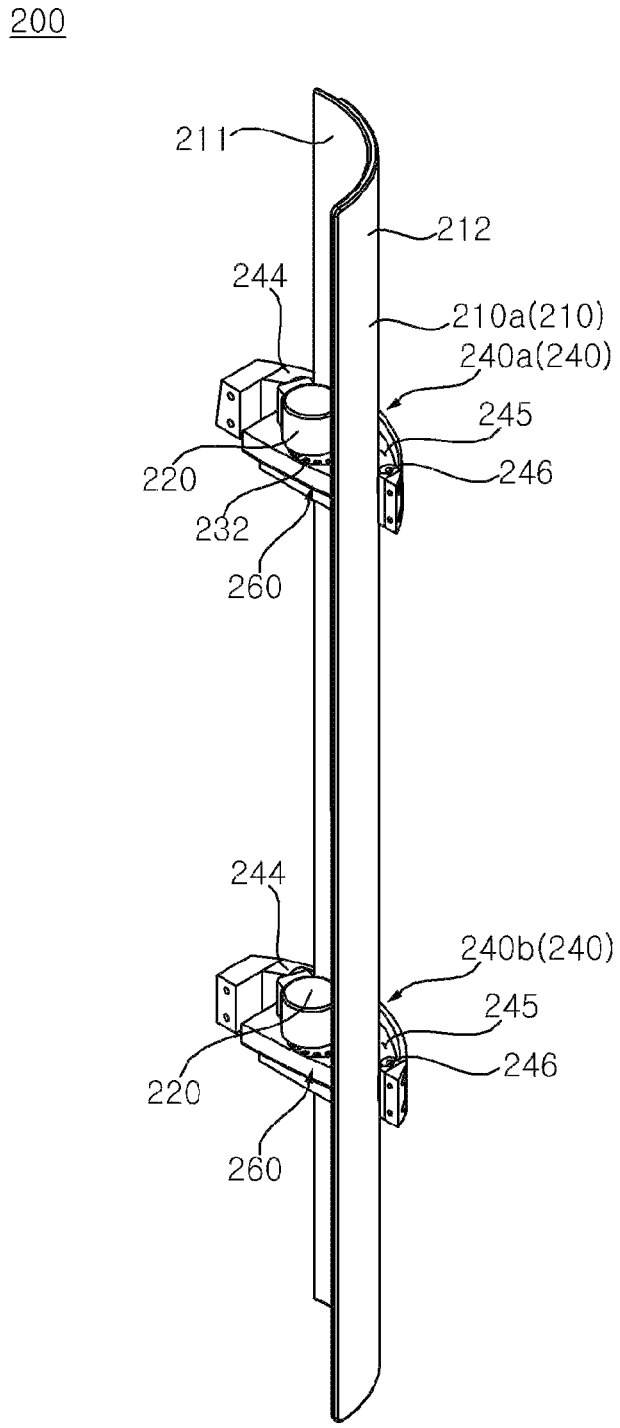
Figure 16:
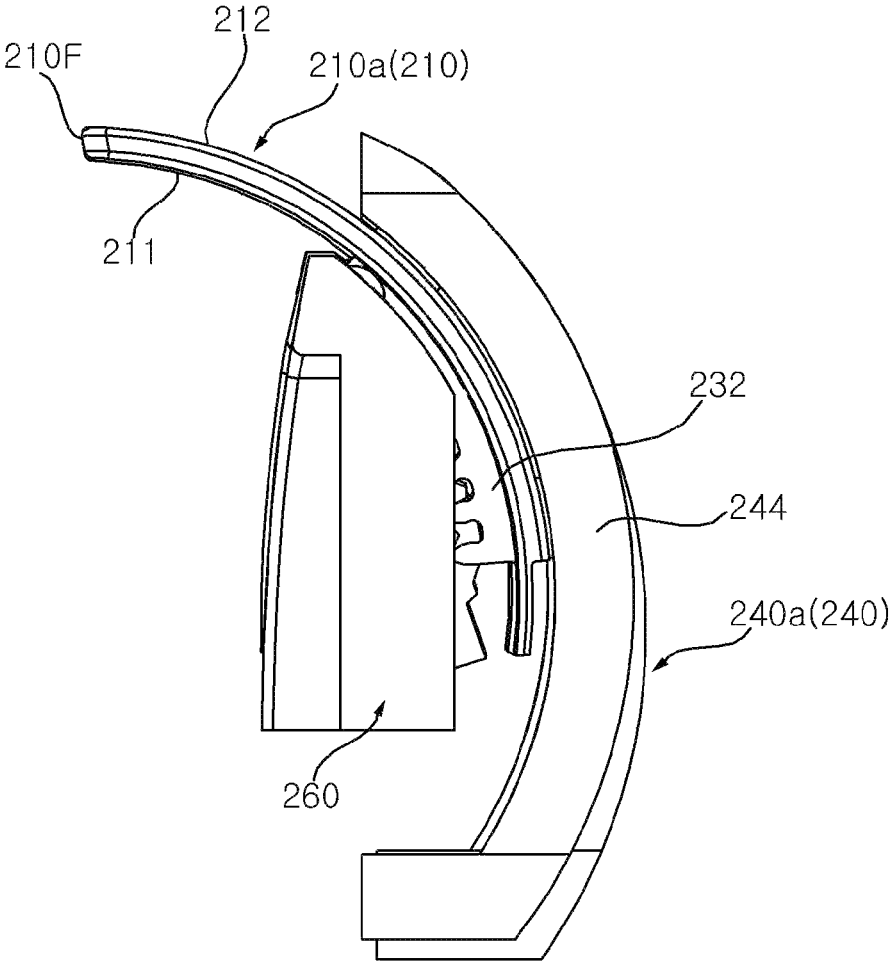

Referring to FIGS. 14 to 16, the door assembly 200 may include, other than the door 210 and the door guide 240 described above, a motor 220, a power transmission member 230, a light emission member 250, and a motor mount 260. In this case, the motor 220, the power transmission member 230, the light emission member 250, and the motor mount 260 each may be connected or coupled to the first door guide 240*a* and the second door guide 240*b*.

The motor 220 can provide a rotational force. The motor 220 may be a step motor of which the rotation direction, the rotation speed, and the rotation angle can be adjusted. The motor 220 may be fixed or coupled to the motor mount 260. For example, the motor mount 260 is fixed to the inner surfaces of the upper bodies 120 and 130 and coupled to the lower portion of the motor 220, and can support the motor 220.

The power transmission member 230 may include a pinion 231 and a rack 232. The pinion 231 is fixed to the rotary shaft of the motor 220 and can rotate with the rotary shaft. The rack 232 may be engaged with the pinion 231. The rack 232 may be fixed or coupled to the inner surface 211 of the door 210. For example, the rack 232 may have a shape corresponding to the shape of the door 210. In other words, the rack 232 may extending while drawing an arc with a curvature that is the same as or larger than the curvature of the door 210, and gear teeth engaged with the pinion 231 may face the internal spaces of the upper bodies 120 and 130.

Accordingly, the driving force of the motor 220 is transmitted to the door 210 through the power transmission member 230, so the door 2210 can be moved in the circumferential direction of the door 210. Meanwhile, the door 210 includes a transparent material and the light emission member 250 is coupled to the door 210 and can provide light. For example, the light emission member 250 may be an LED. In this case, whether to operate the light emission member 250 or the color of emitted light can be adjusted in correspondence to movement of the door 210.

Meanwhile, the door guide 240 may include a moving guide 242, a fixed guide 244, and friction reduction member 246.

The moving guide 242 is coupled to the door 210 and/or the rack 232 and can move with the door 210 and the rack 232. For example, the moving guide 242 is fixed to the outer surface 212 of the door 210 and may extend while drawing an arc with a curvature that is the same as or smaller than the curvature of the door 210. In this case, the length of the moving guide 242 may be smaller than the length of the door 210.

The fixed guide 244 is coupled to the moving guide 242 outside the moving guide 242 and can support the moving guide 242. In this case, the moving guide 242 may be disposed between the door 210 and the fixed guide 244.

A guide groove 245 is formed on the inner surface of the fixed guide 242 and the moving guide 242 can be movably inserted in the guide groove 245. For example, the guide groove 245 is formed while drawing an arc with a curvature that is the same as the curvature of the moving guide 242, and the length of the guide groove 245 may be larger than the length of the moving guide 242. In this case, an end 245*a* of the guide groove 245 can restrict rotation or movement of the moving guide 242 in a first direction. In this case, the first direction may be a direction in which the door 210 protrudes toward the space 109. Further, another end 245*b* of the guide groove 245 can restrict rotation or movement of the moving guide 242 in a second direction. In this case, the second direction, which is an opposite direction to the first direction, may be a direction opposite to the direction in which the door 210 protrudes toward the space 109.

The friction reduction member 246 can reduce friction due to movement of the moving guide 242 with respect to the fixed guide 244. For example, the friction reduction member 246 may be a roller that is provided to be able to rotate with respect to a central axis that is parallel with the up-down direction. The friction reduction member 246 is coupled to the moving guide 242 and at least a portion of the friction reduction member 246 may protrude in the radial direction of the moving guide 242 and may be movably coupled to the fixed guide 244. For example, the friction reduction member 246 has elasticity and can be supported by the fixed guide 244. For example, the friction reduction member 246 may include a first friction reduction member 246*a* coupled to a side of the moving guide 242 and a second friction reduction member 246*b* coupled to another side.

Accordingly, the door guide 240 can minimize friction or operation noise due to movement of the door 210 and the moving guide 242 while guiding rotation or movement of the door 210 and the moving guide 242.

Meanwhile, the controller can control components of the blower 100' that are connected to the controller such as the fan 150, the door assembly 200, etc. on the basis of input by a user, etc.

Figure 17:
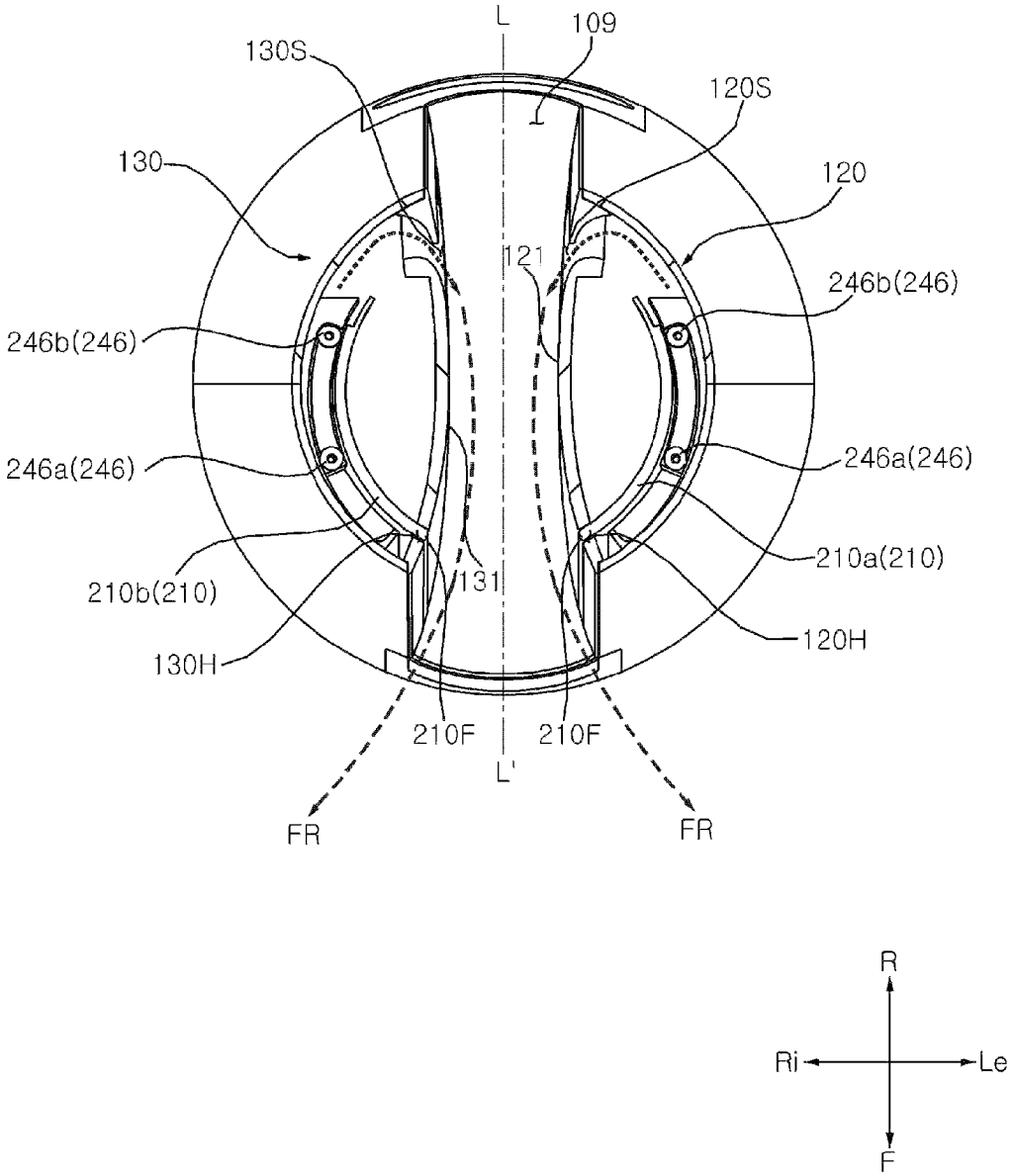
FIG. 17 is a view for describing indirect wind formed by when the door assembly according to the second embodiment closes a front slit.

Referring to FIGS. 12 and 17, the controller can close the first front slit 120H and the second front slit 130H by controlling rotational operations of a first motor 220*a* of the first door assembly 200*a* and a second motor 220*b* of the second door assembly 200*b*. That is, a portion of the first door 210*a* is inserted in the first slot L-H, so the first front slit 120H can be closed, and a portion of the second door 210*b* is inserted in the second slot R-H, so the second front slit 130H can be closed.

Preferably, the front end 210F of the first door 210*a* can form a continuous surface on the surface of the first inner panel 121. Preferably, the front end 210F of the second door 210*b* can form a continuous surface on the surface of the second inner panel 131.

The air of the first channel 120P can be discharged to the space 109 through the first rear slit 120S. The air of the second channel 130P can be discharged to the space 109 through the second rear slit 130S. Further, due to Coanda effect, the air discharged to the space 109 can flow forward along the surface of the first inner panel 121 and the surface of the second inner panel 131 (see FR of FIG. 17). In this case, the gap between the surface of the first inner panel 121 and the surface of the second inner panel 131 may be narrowed toward the center portion from the rear portion of the space 109 and may be widened toward the front portion of the space 109 from the center portion.

Accordingly, the air of the space 109 can flow forward while widely spreading left and right. Meanwhile, this airflow may be referred to as diffusive wind or indirect wind.

Further, such flow of air can form airflow in which the air around the upper bodies 120 and 130 is entrained into the space 109 or flows forward along the surfaces of the outer panels 122 and 132. As a result, the blower 100' can provide a sufficient amount of airflow to a user, etc.

Figure 18:
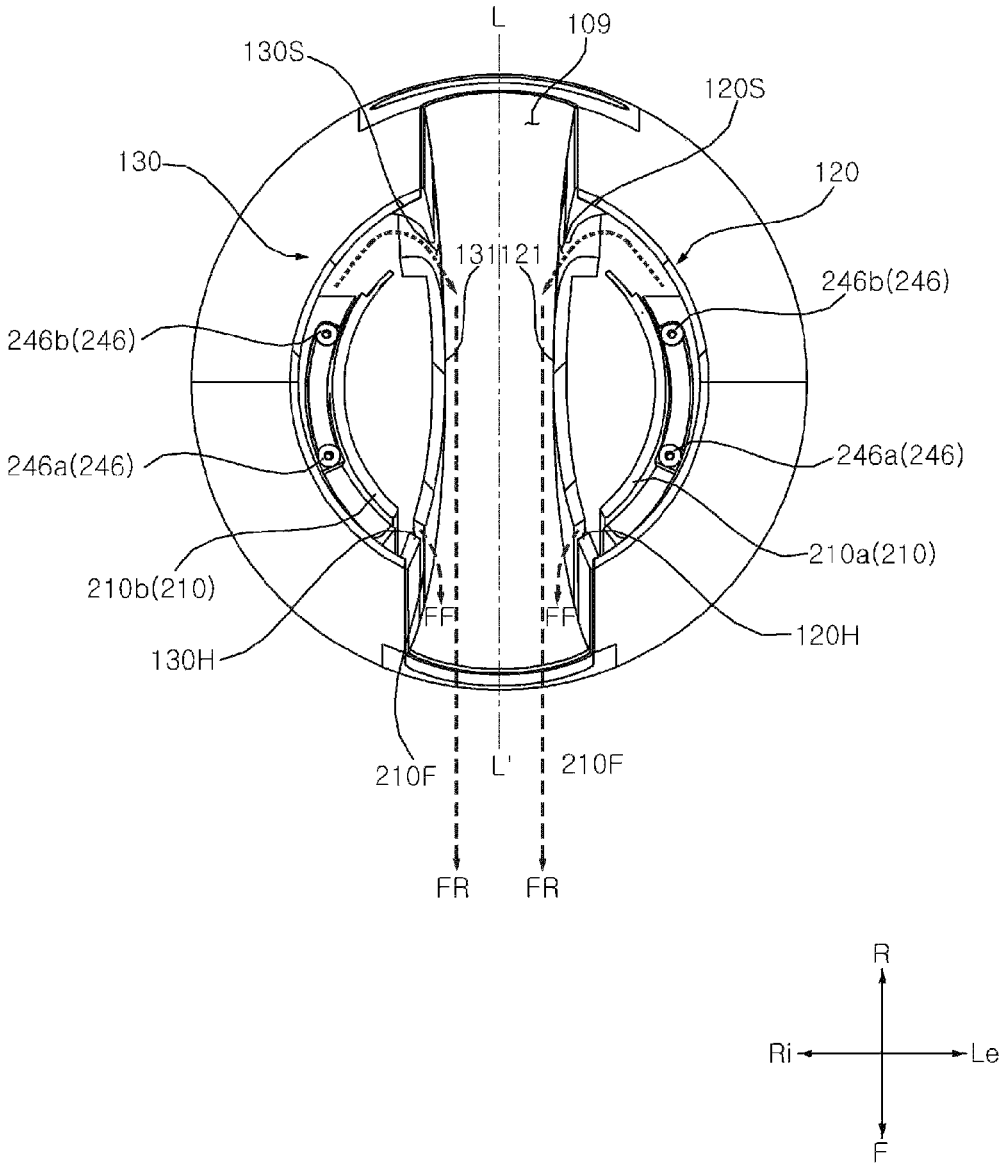
FIG. 18 is a view for describing direct wind formed by when the door assembly according to the second embodiment opens the front slit.

Referring to FIGS. 12 and 18, the controller can open the first front slit 120H and the second front slit 130H by controlling rotational operations of the first motor 220*a* of the first door assembly 200*a* and the second motor 220*b* of the second door assembly 200*b*. That is, the first door 210*a* is separated from the first slot L-H, so the first front slit 120H can be opened, and the second door 210*b* is separated from the second slot R-H, so the second front slit 130H can be opened.

The air of the first channel 120P can be discharged to the space 109 through the first rear slit 120S and the first front slit 120H. The air of the second channel 130P can be discharged to the space 109 through the second rear slit 130S and the second front slit 130H. Further, due to Coanda effect, the air discharged to the space 109 from the first rear slit 120S and the second rear slit 130S can flow forward along the surface of the first inner panel 121 and the surface of the second inner panel 131 (see FR of FIG. 18). Further, the air that is discharged from the first front slit 120H and the second front slit 130H can concentrate air, which flows along the surface of the first inner panel 121 and the surface of the second inner panel 131, to a reference line L-L' (see FF of FIG. 18).

Accordingly, the air of the space 109 can intensively flow forward. Meanwhile, this airflow may be referred to as intensive wind or indirect wind.

Further, such flow of air can form airflow in which the air around the upper bodies 120 and 130 is entrained into the space 109 or flows forward along the surfaces of the outer panels 122 and 132. As a result, the blower 100' can provide a sufficient amount of airflow to a user, etc.

Meanwhile, the controller can adjust the position of the front end 210F of the first door 210*a* with respect to the first slot L-H and the position of the front end 210F of the second door 210*b* with respect to the second slot R-H by controlling rotational operations of the first motor 220*a* of the first door assembly 200*a* and the second motor 220*b* of the second door assembly 200*b*.

For example, the controller can equally adjust the position of the front end 210F of the first door 210*a* with respect to the first slot L-H and the position of the front end 210F of the second door 210*b* with respect to the second slot R-H by synchronizing rotational operations of the first motor 220*a* of the first door assembly 200*a* and the second motor 220*b* of the second door assembly 200*b*.

As another example, the controller can equally adjust the position of the front end 210F of the first door 210*a* with respect to the first slot L-H and the position of the front end 210F of the second door 210*b* with respect to the second slot R-H by differently controlling rotational operations of the first motor 220*a* of the first door assembly 200*a* and the second motor 220*b* of the second door assembly 200*b*.

Figure 19:
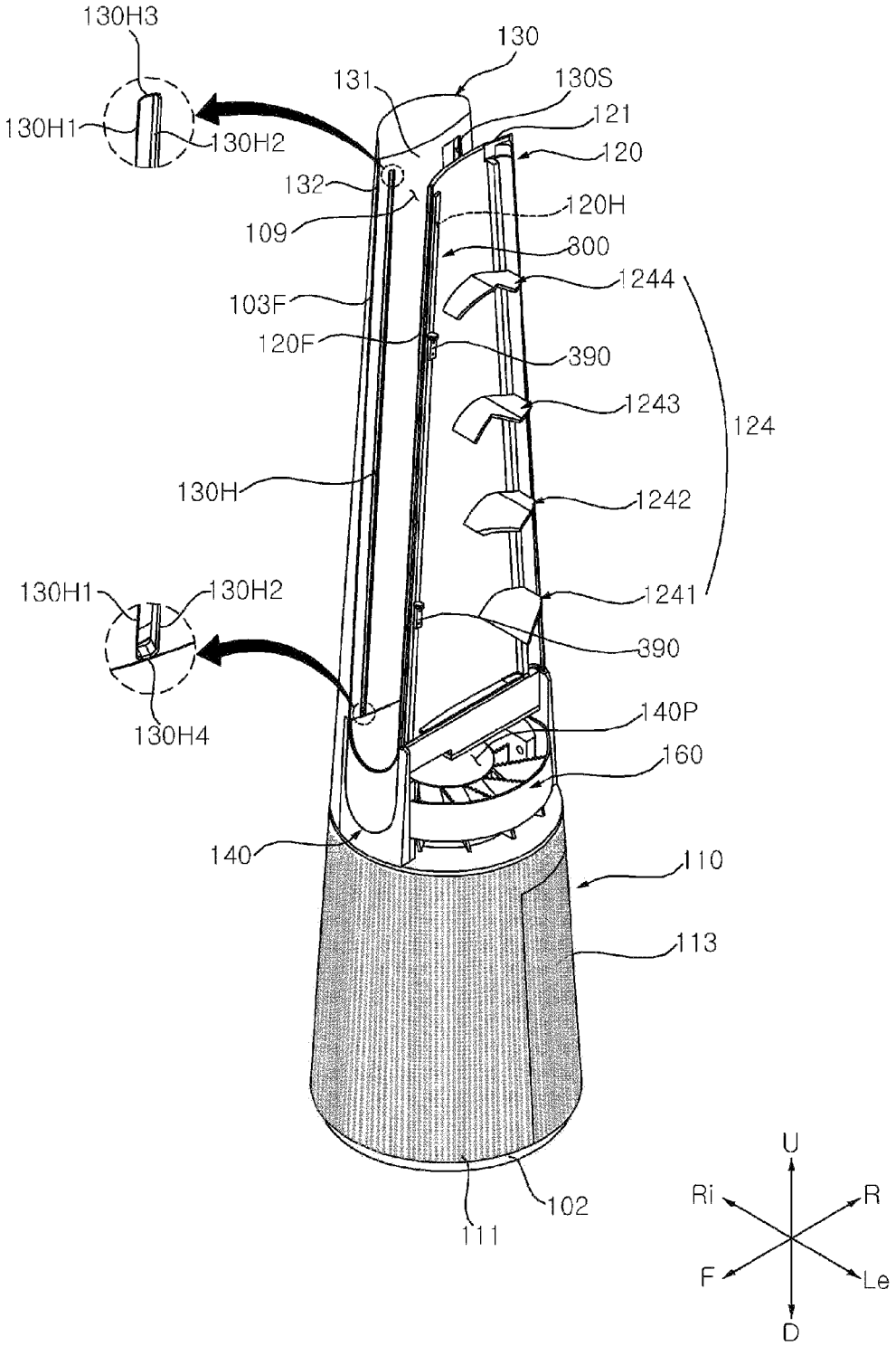
FIG. 19 is a view showing an internal configuration of a blower having a door assembly according to a third embodiment of the present disclosure.

Referring to FIG. 19, a rear vane is installed in the internal space of the first upper body 120 and the internal space of the second upper body 130 and can guide flow of air.

The first rear vane 124 can guide the air, that rises in the first channel 120P, to the first rear slit 120S. The first rear vane 124 may be adjacent to the first rear slit 120S and may be fixed to the inner surface of the first upper body 120. The first rear vane 124 may have an upwardly convex shape. The first rear vane 124 may include a plurality of first rear vanes 1241, 1242, 1243, and 1244 spaced apart from each other in the up-down direction. The plurality of first rear vanes 1241, 1242, 1243, and 1244 each have an end adjacent to the first rear slit 120S, and the plurality of first rear vanes 1241, 1242, 1243, and 1244 may be spaced apart from each other along the first rear slit 120S. The shapes of the plurality of first rear vanes 1241, 1242, 1243, and 1244 may be different from each other.

For example, the curvature of a rear vane positioned at a relatively low side of the plurality of first rear vanes 1241, 1242, 1243, and 1244 may be larger than the curvature of a rear vane positioned at a relatively high side. In this case, the position of another end opposite to the end of a rear vane positioned at a relatively low side of the plurality of first rear vanes 1241, 1242, 1243, and 1244 may be the same as or lower than the end, and the position of another end opposite to the end of a rear vane positioned at a relatively high side may be the same as or higher than the end.

Accordingly, the first rear vane 124 can smoothly guide the air, that rises in the first channel 120P, to the first rear slit 120S.

The second rear vane 134 (not shown) can guide the air, that rises in the second channel 130P, to the second rear slit 130S. The second vane 134 and the first vane 124 may be left-right symmetric.

Figure 20:
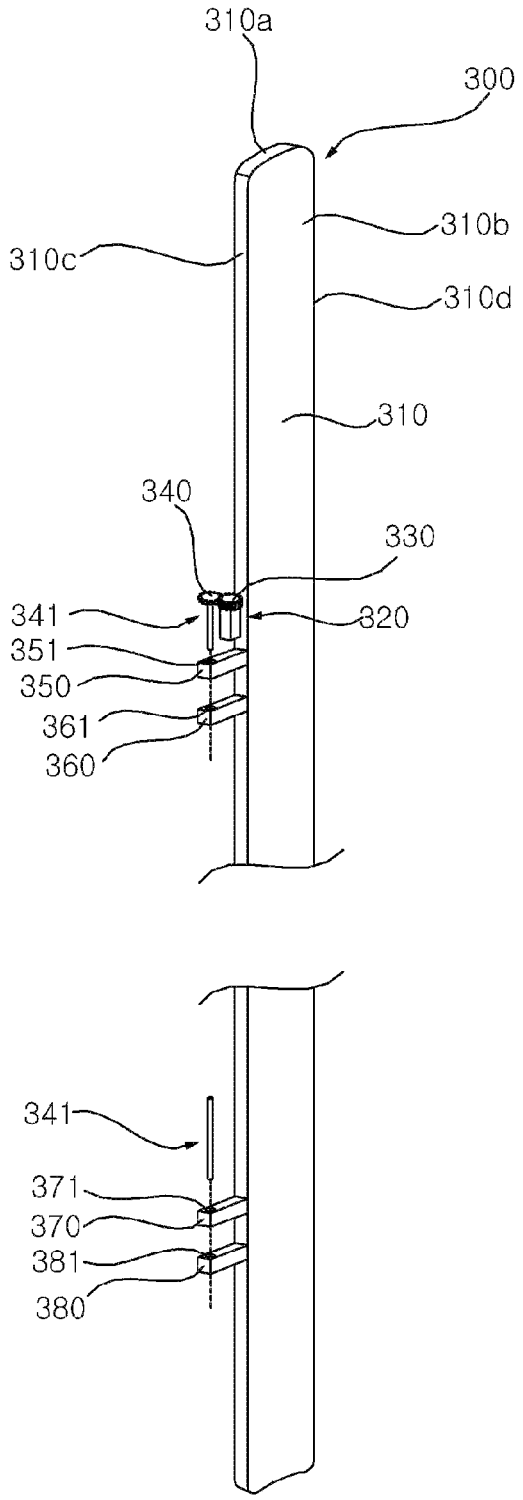
FIG. 20 is a view for describing the door assembly according to the third embodiment of the present disclosure.

Referring to FIGS. 19 and 20, a door assembly 300 may be installed at the upper bodies 120 and 130. The door assembly 300 installed at the first upper body 120 can open and close the first front slit 120H. The door assembly 300 installed at the second upper body 130 can open and close the second front slit 130H. Meanwhile, the door assembly 300 may be referred to as an air flow converter.

The door assembly 300 may include a door 310, a motor 320, a pinion 330, a gear 340, a door shaft 341, and a connector 350, 360, 370, 380.

The door 310 may be installed to be able to rotate or pivot in the internal space of the first upper body 120 or the internal space of the second upper body 130. The door 310 may be a plate elongated in the longitudinal direction of the first front slit 120H or the second front slit 130H. The area of the door 310 may be larger than the size of the first slot L-H or the second slot R-H. Meanwhile, the door 310 may be referred to as a board.

Further, a first surface 310*a* of the door 310 may be a curved surface having a curvature that is the same as the surface of the first inner panel 121 or the surface of the second inner panel 131. A second surface 310*b* of the door 310 may be opposite to the first surface 310*a* and may face the internal space of the first upper body 120 or the internal space of the second upper body 130.

When the door 310 closes the first front slit 120H or the second front slit 130H, a third surface 310*c* of the door 310 can come in contact with a front boundary surface of the first front slit 120H or a front boundary surface 130H1 of the second front slit 130H. A fourth surface 310*d* of the door 310 may be opposite to the third surface 310*c*. When the door 310 closes the first front slit 120H or the second front slit 130H, the fourth surface 310*d* of the door 310 can come in contact with a rear boundary surface of the first front slit 120H or a rear boundary surface 130H2 of the second front slit 130H. Meanwhile, the third surface 310*c* may be referred to as a first border 310*c* and the fourth surface 310*d* may be referred to as a second border 310*d*.

When the door 310 closes the first front slit 120H or the second front slit 130H, an upper surface of the door 310 can come in contact with an upper boundary surface of the first front slit 120H or an upper boundary surface 130H3 of the second front slit 130H, and a lower surface of the door 310 can come in contact with a lower boundary surface of the first front slit 120H or a lower boundary surface 130H4 of the second front slit 130H.

The motor 320 can provide a rotational force. The motor 320 may be a step motor of which the rotation direction, the rotation speed, and the rotation angle can be adjusted. The motor 320 may be fixed or coupled to a motor mount 390. For example, the motor mount 390 is fixed to the inner surfaces of the upper bodies 120 and 130 and can support the motor 320.

The pinion 330 is fixed to the rotary shaft of the motor 320 and can rotate with the rotary shaft. The gear 340 may be engaged with the pinion 330. The door shaft 341 is fixed to the gear 340 and may extend in the longitudinal direction of the door 310. The door shaft 341 can provide a rotary shaft of the door 310. Meanwhile, the door shaft 341 may be referred to as a rotary shaft, a pivot shaft, or a hinge shaft.

The connector 350, 360, 370, 380 may be provided at the first border 310*c*. The door shaft 341 may be inserted and fixed in the connector 350, 360, 370, 380. Accordingly, the rotation radius of the first border 310*c* may be smaller than the rotation radius of the second border 310*d*.

For example, the connector 350, 360, 370, 380 may include a plurality of connectors spaced apart from each other in the longitudinal direction of the door 310. A first connector 350, a second connector 360, a third connector 370, and a fourth connector 380 may be sequentially disposed in the up-down direction. A first shaft hole 351, a second shaft hole 361, a third shaft hole 371, and a fourth shaft hole 381 may be formed at the first connector 350, the second connector 360, the third connector 370, and the fourth connector 380, respectively.

In this case, the first and second connectors 350 and 360 may be positioned over the third and fourth connectors 370 and 380. For example, the motor 320 can provide power to the first and second connectors 350 and 360 and the third and fourth connectors 370 and 380. As another example, the motor 320 may include an upper motor that provides power to the first and second connectors 350 and 360 and a lower motor that provides power to the third and fourth connectors 370 and 380. The door shaft 341 connected to the upper motor may be fixed to the first and second connectors 350 and 360 and the door shaft 341 connected to the lower motor may be fixed to the third and fourth connectors 370 and 380.

Accordingly, when the motor 320 is driven, the door 310 can be rotated around the door shaft 341.

Meanwhile, the controller can control components of the blower 100" that are connected to the controller such as the fan 150, the door assembly 300, etc. on the basis of input by a user, etc.

Figure 21:
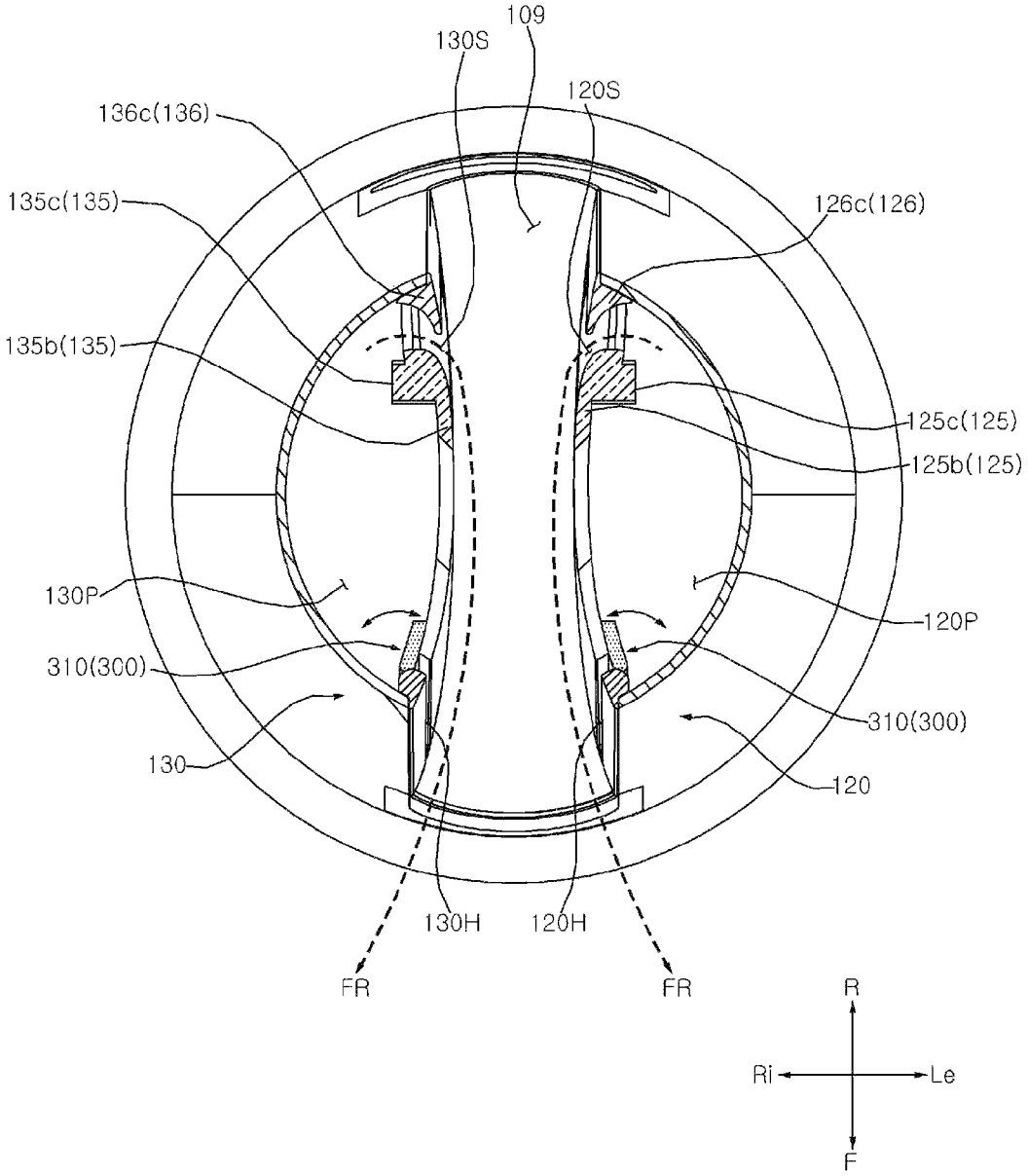
FIG. 21 is a view for describing indirect wind formed by when the door assembly according to the third embodiment closes a front slit.

Referring to FIG. 21, the controller can close the first front slit 120H and the second front slit 130H by controlling operations of the first motor 320 of the door assembly 300 installed at the first upper body 120 and the second motor 320 of the door assembly 300 installed at the second upper body 130. That is, the door 310 of the door assembly 300 installed at the first upper body 120 covers the first slot L-H in the first channel 120P, so the first front slit 120H can be closed, and the door 310 of the door assembly 300 installed at the second upper body 130 closes the second slot R-H in the second channel 130P, so the second front slit 130H can be closed.

The air of the first channel 120P can be discharged to the space 109 through the first rear slit 120S. The air of the second channel 130P can be discharged to the space 109 through the second rear slit 130S. Further, due to Coanda effect, the air discharged to the space 109 can flow forward along the surface of the first inner panel 121 and the surface of the second inner panel 131 (see FR of FIG. 21). In this case, the gap between the surface of the first inner panel 121 and the surface of the second inner panel 131 may be narrowed toward the center portion from the rear portion of the space 109 and may be widened toward the front portion of the space 109 from the center portion.

Accordingly, the air of the space 109 can flow forward while widely spreading left and right. Meanwhile, this airflow may be referred to as diffusive wind or indirect wind.

Further, such flow of air can form airflow in which the air around the upper bodies 120 and 130 is entrained into the space 109 or flows forward along the surfaces of the outer panels 122 and 132. As a result, the blower 100" can provide a sufficient amount of airflow to a user, etc.

Figure 22:
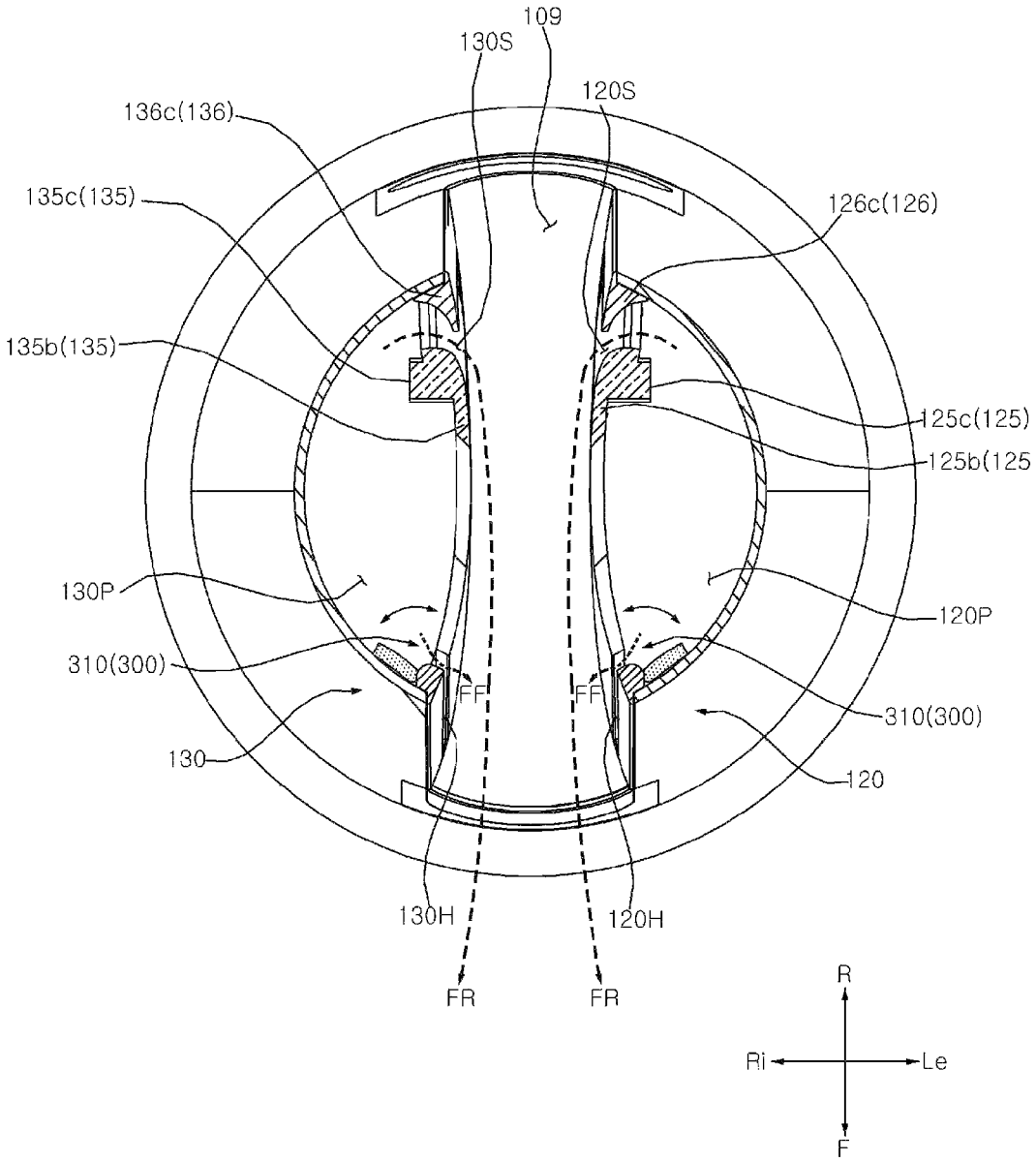
FIG. 22 is a view for describing direct wind formed by when the door assembly according to the third embodiment opens the front slit.

Referring to FIG. 22, the controller can open the first front slit 120H and the second front slit 130H by controlling operations of the first motor 320 of the door assembly 300 installed at the first upper body 120 and the second motor 320 of the door assembly 300 installed at the second upper body 130. That is, the door 310 of the door assembly 300 installed at the first upper body 120 rotates away from the first slot L-H, so the first front slit 120H can be closed, and the door 310 of the door assembly 300 installed at the second upper body 130 rotates away from the second slot R-H, so the second front slit 130H can be closed.

The air of the first channel 120P can be discharged to the space 109 through the first rear slit 120S and the first front slit 120H. The air of the second channel 130P can be discharged to the space 109 through the second rear slit 130S and the second front slit 130H. Further, due to Coanda effect, the air discharged to the space 109 from the first rear slit 120S and the second rear slit 130S can flow forward along the surface of the first inner panel 121 and the surface of the second inner panel 131 (see FR of FIG. 22). Further, the air that is discharged from the first front slit 120H and the second front slit 130H can concentrate air, which flows along the surface of the first inner panel 121 and the surface of the second inner panel 131, to a reference line extending forward and rearward through the center of the space 190 (see FF of FIG. 22).

Accordingly, the air of the space 109 can intensively flow forward. Meanwhile, this airflow may be referred to as intensive wind or indirect wind.

Further, such flow of air can form airflow in which the air around the upper bodies 120 and 130 is entrained into the space 109 or flows forward along the surfaces of the outer panels 122 and 132. As a result, the blower 100' can provide a sufficient amount of airflow to a user, etc.

Figure 23:
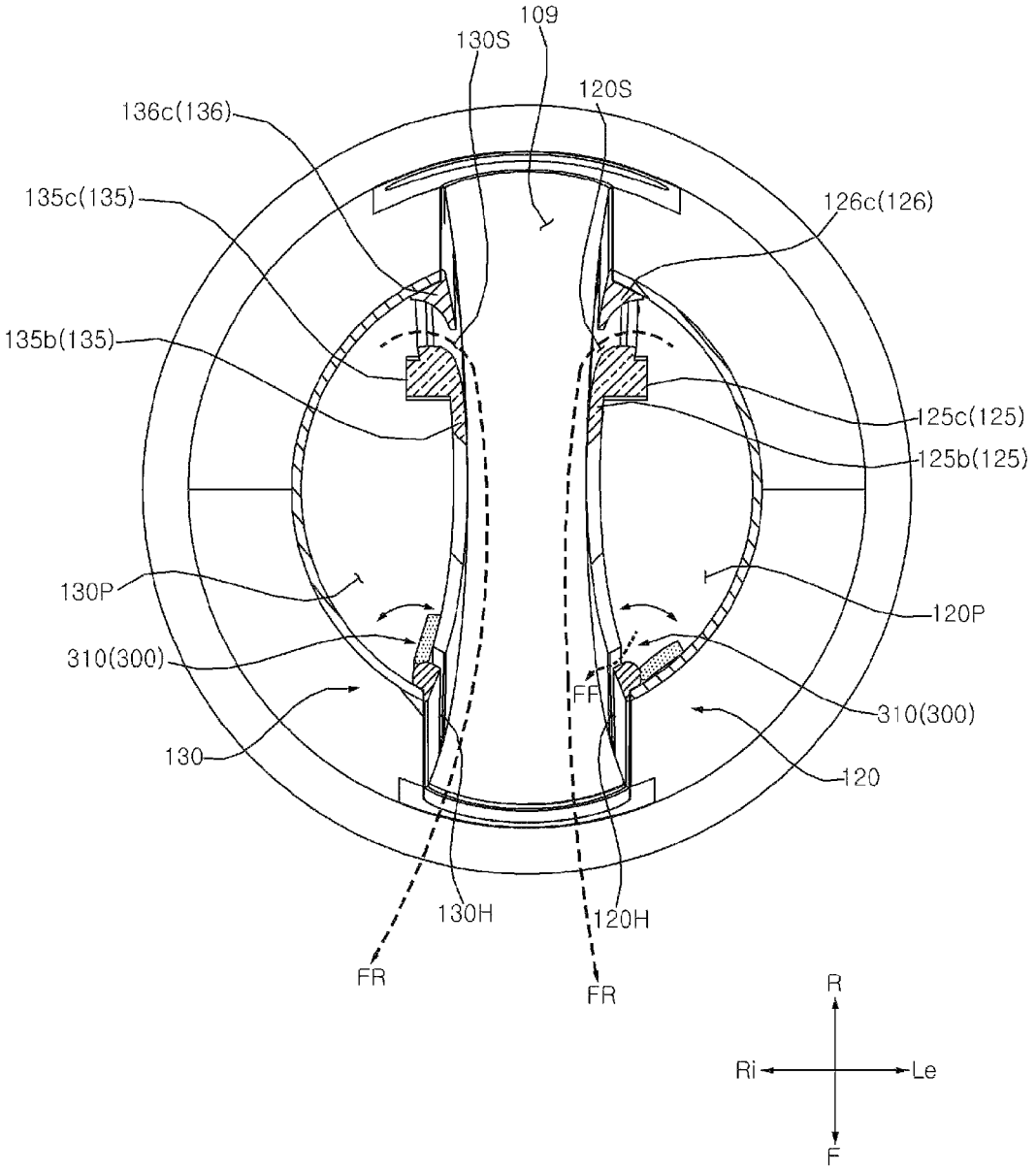
FIGS. 23 and 24 are views for describing airflow that is formed when the door assembly according to the third embodiment opens any one of a pair of front slits and closes the other one, that is.
Figure 24:
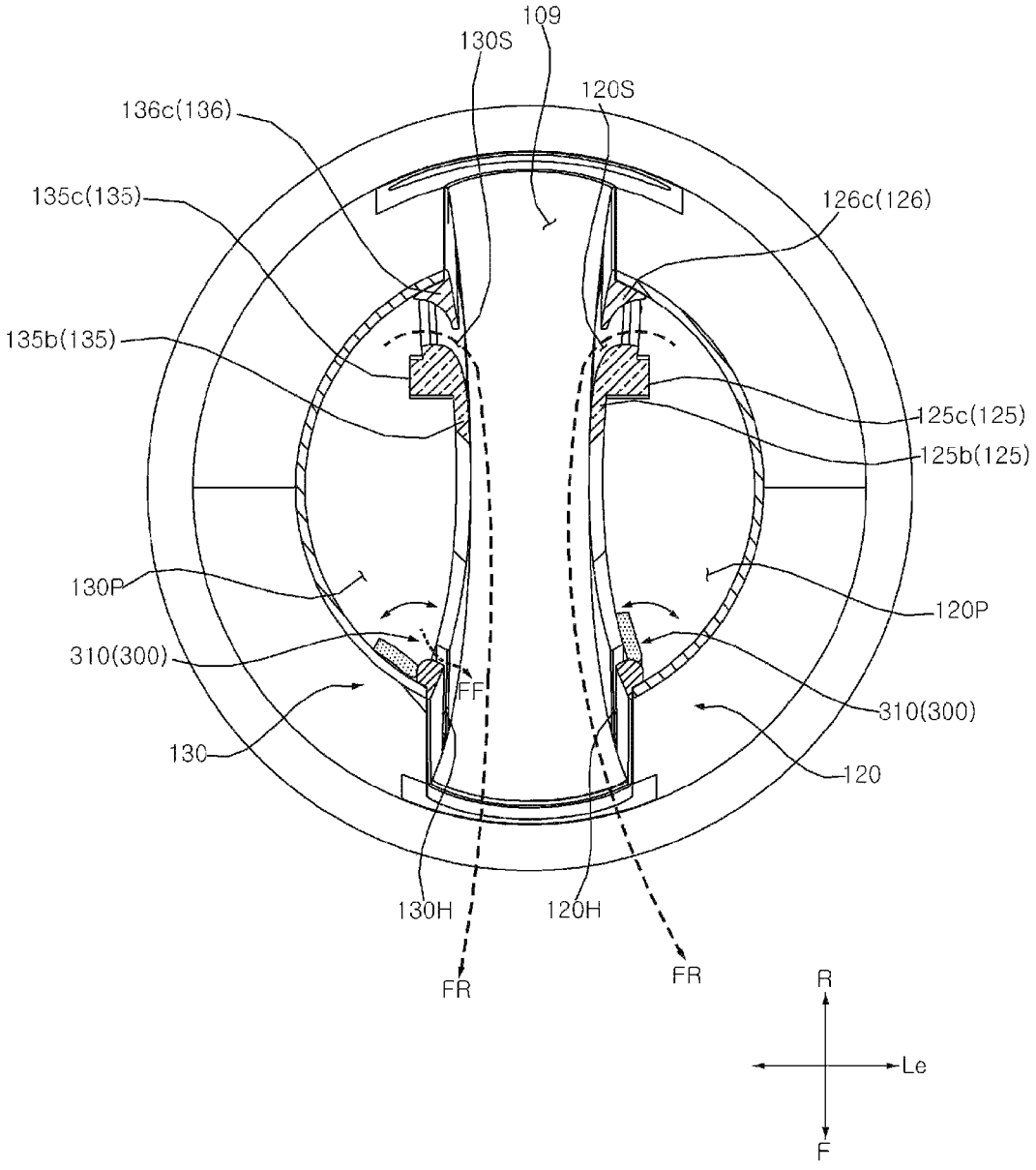

Referring to FIGS. 23 and 24, the controller can adjust the position of the first door 310 with respect to the first slot L-H and the position of the door 320 with respect to the second slot R-H by controlling rotational operations of the motor 320 of the door assembly 300 installed at the first upper body 120 and the motor 320 of the door assembly 300 installed at the second upper body 130.

For example, the controller can equally adjust the position of the first door 310 with respect to the first slot L-H and the position of the door 320 with respect to the second slot R-H by synchronizing rotational operations of the motor 320 of the door assembly 300 installed at the first upper body 120 and the motor 320 of the door assembly 300 installed at the second upper body 130.

As another example, the controller can differently adjust the position of the first door 310 with respect to the first slot L-H and the position of the door 320 with respect to the second slot R-H by differently controlling rotational operations of the motor 320 of the door assembly 300 installed at the first upper body 120 and the motor 320 of the door assembly 300 installed at the second upper body 130.

Referring to FIG. 23, the door 310 installed at the first upper body 120 can open the first front slit 120H or the door 310 installed at the second upper body 130 can close the second front slit 120H. In this case, the blower 100" can provide airflow biased to the right to a user, etc.

Referring to FIG. 24, the door 310 installed at the first upper body 120 can close the first front slit 120H or the door 310 installed at the second upper body 130 can open the second front slit 120H. In this case, the blower 100" can provide airflow biased to the left to a user, etc.

Certain embodiments or other embodiments of the disclosure described above are not mutually exclusive or distinct from each other. Any or all elements of the embodiments of the disclosure described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A blower comprising:

a fan generating flow of air;

a lower body providing an internal space in which the fan is installed, and having a suction hole through which air passes; and a first upper body disposed above the lower body, and forming a first channel that communicates with the internal space of the lower body;

a second upper body disposed above the lower body, spaced apart in a left-right direction from the first upper, body and forming a second channel that communicates with the internal space of the lower body;

a space formed between the first upper body and the second upper body, opened in a front-rear direction;

a first rear slit disposed at a surface of the first upper body facing the space, being adjacent to a rear end of the first upper body;

a second rear slit disposed at a surface of the second upper body facing the space, being adjacent to a rear end of the second upper body;

a first front slit disposed at the surface of the first upper body facing the space, being adjacent to a front end of the first upper body;

a second front slit disposed at the surface of the second upper body facing the space, being adjacent to a front end of the second upper body;

a first door assembly installed in the first upper body and opening or closing the first front slit; and a second door assembly installed in the second upper body and opening or closing the second front slit.

2. The blower of claim 1, wherein the first rear slit is formed through the first upper body in a direction facing the space and inclined forward, and the first front slit is formed through the first upper body in a direction facing a front portion of the space and inclined forward.

3. The blower of claim 2, wherein the first upper body includes an inner panel that faces the space and at which the first rear slit and the first front slit are formed.

4. The blower of claim 3, wherein the first upper body further includes:

an inner sleeve forming the first channel; and a panel surrounding the inner sleeve, having the inner panel and an outer panel opposite to the inner panel, and the inner panel forms the front end and the rear end of the first upper body by being in contact with the outer panel.

5. The blower of claim 4, wherein the first upper body further includes:

an opening being adjacent to the rear end of the first upper body, having an inlet positioned at the first channel and an outlet forming the first rear slit; and a slot being adjacent to the front end of the first upper body, having an inlet positioned at the first channel and an outlet forming the first front slit, and wherein the opening is shaped curved as the inlet is positioned backward than the outlet.

6. The blower of claim 1, the first door assembly includes:

a first door opening and closing the first front slit; and a first motor installed in the first upper body and providing power to the first door, and the first door can slide or rotate in the first upper body.

7. The blower of claim 6, wherein a surface of the first upper body that faces the space is a curved surface that is convex toward the space, and a surface of the first door that faces the space is a curved surface having the same curvature as the surface of the first upper body that faces the space.

8. The blower of claim 7, wherein the first door opens and closes the first front slit by sliding in a circumferential direction of the first door in the first upper body in correspondence to operation of the first motor.

9. The blower of claim 8, wherein the first door further includes:

a first door plate elongated in a longitudinal direction of the first front slit and being able to slide in the circumferential direction of the first door; and a first door pin protruding from the first door plate, the first door assembly further includes:

a first pinion fixed to a rotary shaft of the first motor; and a first link having a first rack engaged with the first pinion, the first link includes a first guide groove provided on a side of the first link and extending in a direction crossing a movement direction of the first rack, and the first door pin is coupled to the first guide groove to be movable in a longitudinal direction of the first guide groove.

10. The blower of claim 9, further comprising:

a first upper guide coupled to an upper end of the first door plate and guiding movement of the first door plate; and a first lower guide coupled to a lower end of the first door plate and guiding movement of the first door plate.

11. The blower of claim 6, wherein the first door opens and closes the first front slit by moving while drawing an arc in the first upper body in correspondence to operation of the first motor.

12. The blower of claim 11, wherein the first door includes a front end that can be inserted in the first front slit in a circumferential direction of the first door, and the first door assembly further includes:

a power transmission member transmitting power of the first motor to the first door; and a door guide provided on a side of the first door and guiding movement of the first door in the first upper body.

13. The blower of claim 6, wherein the first door opens and closes the first front slit by pivoting toward or away from the first front slit in the first upper body in correspondence to operation of the first motor.

14. The blower of claim 13, wherein an area of the first door is larger than a size of the first front slit, the first door includes a first surface covering or separating from the first front slit in the first upper body, and the first door assembly further includes:

a first door shaft receiving power of the first motor and forming a pivot center of the first door; and a first connector that is provided on a side of the first door and to which the first door shaft is fixed.

15. The blower of claim 1, further includes a controller electrically coupled to the first door assembly and the second door assembly and controlling operations of the first door assembly and the second door assembly, and wherein the controller equally adjusts opening and closing of the first front slit and opening and closing of the second front slit by synchronizing operations of the first door assembly and the second door assembly.

16. The blower of claim 1, further includes a controller electrically coupled to the first door assembly and the second door assembly and controlling operations of the first door assembly and the second door assembly, and wherein the controller differently adjusts opening and closing of the first front slit and opening and closing of the second front slit by differently controlling operations of the first door assembly and the second door assembly.

17. The blower of claim 1, when the first door assembly close the first front slit, an end portion of a first door of the first door assembly forms a continuous surface with the surface of the first upper body facing the space, and when the second door assembly close the second front slit, an end portion of a second door of the second door assembly forms a continuous surface with the surface of the second upper body facing the space.

18. The blower of claim 1, wherein the first front slit is spaced apart 9 backwardly from the front end of the first upper body, and wherein the second front slit is spaced apart backwardly from the front end of the second upper body.

19. The blower of claim 1, wherein the first and second upper bodies, the first and second rear slits, and the first and second front slits are extending long in an up-down direction, wherein at least one of the first rear slit and the first front slit is tilted toward a vertical axis of the blower such that an imaginary straight line extended from them is crossed, and wherein at least one of the second rear slit and the second front slit is tilted toward the vertical axis of the blower such that an imaginary straight line extended from them is crossed.

* * * * *